US010136509B2

(12) United States Patent
Hori et al.

(10) Patent No.: US 10,136,509 B2
(45) Date of Patent: Nov. 20, 2018

(54) TARGET SUPPLY DEVICE, PROCESSING DEVICE AND PROCESSING METHOD THEFEFOR

(71) Applicant: Gigaphoton Inc., Tochigi (JP)

(72) Inventors: Tsukasa Hori, Oyama (JP); Yutaka Shiraishi, Oyama (JP); Shinya Ikesaka, Oyama (JP); Takanobu Ishihara, Oyama (JP); Toshiro Umeki, Oyama (JP)

(73) Assignee: Gigaphoton Inc., Tochigi (JP)

( * ) Notice: Subject to any disclaimer, the term of this patent is extended or adjusted under 35 U.S.C. 154(b) by 0 days.

(21) Appl. No.: 15/616,167

(22) Filed: Jun. 7, 2017

(65) Prior Publication Data

US 2017/0280543 A1 Sep. 28, 2017

Related U.S. Application Data

(63) Continuation of application No. PCT/JP2015/052408, filed on Jan. 28, 2015.

(51) Int. Cl.
*H05G 2/00* (2006.01)

(52) U.S. Cl.
CPC ..... *H05G 2/006* (2013.01); *H05G 2/005* (2013.01); *H05G 2/008* (2013.01)

(58) Field of Classification Search
CPC ..... H05G 2/00; H05G 2/001; H05G 2/003; H05G 2/005; H05G 2/006
USPC ..... 250/504 R
See application file for complete search history.

(56) References Cited

U.S. PATENT DOCUMENTS

| | | | | |
|---|---|---|---|---|
| 7,449,703 | B2 | 11/2008 | Bykanov | |
| 8,343,429 | B2 | 1/2013 | Yabu et al. | |
| 2005/0263449 | A1 | 12/2005 | Juma | |
| 2006/0192155 | A1 | 8/2006 | Algots et al. | |
| 2006/0193997 | A1 | 8/2006 | Bykanov | |
| 2007/0090304 | A1* | 4/2007 | Jonkers | H05G 2/003 250/504 R |
| 2010/0096099 | A1* | 4/2010 | Takashina | B22C 9/086 164/134 |
| 2010/0097593 | A1* | 4/2010 | Murakami | G03F 7/70033 355/67 |
| 2010/0200776 | A1 | 8/2010 | Yabu et al. | |

(Continued)

FOREIGN PATENT DOCUMENTS

| | | | |
|---|---|---|---|
| JP | 2006-512209 | A | 4/2006 |
| JP | 2008-063569 | A | 3/2008 |

(Continued)

OTHER PUBLICATIONS

International Search Report issued in PCT/JP2015/052408; dated Apr. 28, 2015.

(Continued)

*Primary Examiner* — Jason McCormack
(74) *Attorney, Agent, or Firm* — Studebaker & Brackett PC

(57) ABSTRACT

A target supply device according to a first aspect of the present disclosure is configured to supply a metal target in a plasma generation region and may include a tank configured to house the metal target, a filter having been subjected to a dehydration process, the filter being configured to suppress passage of particles in the metal target housed in the tank, and a nozzle provided with a nozzle hole configured to eject the metal target that has passed through the filter.

19 Claims, 21 Drawing Sheets

(56) References Cited

U.S. PATENT DOCUMENTS

| | | | | |
|---|---|---|---|---|
| 2012/0025434 | A1 | 2/2012 | Demey et al. | |
| 2012/0292527 | A1* | 11/2012 | Fomenkov | B22F 3/105 250/432 R |
| 2013/0077071 | A1 | 3/2013 | Van Den Akker et al. | |
| 2013/0146682 | A1 | 6/2013 | Ishihara et al. | |
| 2013/0221587 | A1 | 8/2013 | Shiraishi et al. | |
| 2014/0070021 | A1 | 3/2014 | Yabu et al. | |
| 2014/0148329 | A1* | 5/2014 | Beall | B28B 11/243 501/32 |
| 2014/0151582 | A1 | 6/2014 | Rollinger et al. | |
| 2015/0144809 | A1 | 5/2015 | Okazaki et al. | |

FOREIGN PATENT DOCUMENTS

| | | | |
|---|---|---|---|
| JP | 2008-226462 | A | 9/2008 |
| JP | 2010-199560 | A | 9/2010 |
| JP | 2013-070040 | A | 4/2013 |
| JP | 2013-140771 | A | 7/2013 |
| JP | 2013-530029 | A | 7/2013 |
| JP | 2014-056891 | A | 3/2014 |
| JP | 2014-517980 | A | 7/2014 |
| WO | 2014/024865 | A1 | 2/2014 |

OTHER PUBLICATIONS

The International Preliminary Report on Patentability (Chapter I) and Translation of Written Opinion of the International Searching Authority; PCT/JP2015/052408; dated Aug. 1, 2017.

An Office Action; "Notification of Reasons for Refusal" issued by the Japanese Patent Office dated Jul. 27, 2018, which corresponds to Japanese Patent Application No. 2016-571585 and is related to U.S. Appl. No. 15/616,167; with English Translation.

* cited by examiner

FIG.15

| PATTERN | RELATION BETWEEN PRESSURE P1b IN TANK AND PRESSURE P2b IN CHAMBER AT BAKING | PRESSURE P1b IN TANK AT BAKING | BAKING TEMPERATURE Tb [°C] | BAKING TIME Hb [hour] |
|---|---|---|---|---|
| 1 | P2b(1e-3Pa)<P1b | ~1E-2Pa | 150 | 2 |
| 2 | P2b(1e-3Pa)<P1b | ~1E-2Pa | 210 | 2 |
| 3 | P2b(1e-3Pa)<P1b | ~1E-2Pa | 220 | 2 |
| 4 | P2b(1e-3Pa)<P1b | ~1E-2Pa | 220 | 4 |
| 5 | P2b(1e-3Pa)<P1b | ~1Pa | 220 | 28 |
| 6 | P2b(1Pa)<P1b | ~10Pa | 220 | 4 |
| 7 | P2b(1Pa)<P1b | ~10Pa | 220 | 28 |
| 8 | P2b(1e-3Pa)<P1b | ~1MPa | 220 | 28 |
| 9 | P2b(1Pa)<P1b | ~1MPa | 220 | 28 |
| 10 | P2b(1e-3Pa)<P1b | ~2MPa | 220 | 52 |
| 11 | P2b(1Pa)<P1b | ~2MPa | 220 | 52 |

TARGET SUPPLY DEVICE, PROCESSING DEVICE AND PROCESSING METHOD THEFEFOR

CROSS-REFERENCE TO RELATED APPLICATIONS

The present application is a continuation application of International Application No. PCT/JP2015/052408 filed on Jan. 28, 2015. The content of the application is incorporated herein by reference in its entirety.

BACKGROUND

1. Technical Field

The present disclosure relates to a target supply device, and a processing device and a processing method for the target supply device.

2. Related Art

In recent years, along with miniaturization of a semiconductor process, miniaturization of a transfer pattern for photolithography in the semiconductor process has been progressing at rapid speeds. In a next generation, fine patterning of 70-45 nm and further, fine patterning of 32 nm or less will be required. Therefore, to meet a requirement for the fine patterning of 32 nm or less, for example, a development of an exposure device composed of a combination of a device for generating extreme ultraviolet (EUV) light of a wavelength of approximately 13 nm and reduced projection reflective optics has been expected.

Following three kinds of devices have been proposed as EUV light generation devices: laser produced plasma (LPP) devices that use plasma generated by irradiation of target substances with laser beam, discharge produced plasma (DPP) devices that use plasma generated by discharge, and synchrotron radiation (SR) devices that use synchrotron orbital radiation.

CITATION LIST

Patent Literature

Patent Literature 1: U.S. Patent Application Publication No. 2013/0221587

Patent Literature 2: U.S. Patent Application Publication No. 2006/0192155

Patent Literature 3: U.S. Pat. No. 7,449,703

Patent Literature 4: U.S. Pat. No. 8,343,429

Patent Literature 5: U.S. Patent Application Publication No. 2012/0292527

SUMMARY

A target supply device according to an aspect of the present disclosure may be configured to supply a metal target in a plasma generation region. The target supply device may include a tank, a filter and a nozzle. The tank may be configured to store the metal target. The filter may have been subjected to a dehydration process. The filter may be configured to suppress passage of particles in the metal target stored in the tank. The nozzle may be provided with a nozzle hole. The nozzle may be configured to eject, from the nozzle hole, the metal target that has passed through the filter.

A processing device according to another aspect of the present disclosure may be a processing device for a target supply device. The target supply device may be configured to supply a metal target in a plasma generation region. The processing device may include a chamber, an exhaust device, the target supply device, a heater, a pressure adjuster, and a control unit. The exhaust device may be configured to exhaust an inside of the chamber. The target supply device may be provided in the chamber. The heater may be configured to heat the target supply device. The pressure adjuster may be configured to supply an inactive gas to the target supply device. The control unit may be configured to control the heater, the exhaust device, and the pressure adjuster. The target supply device may include the metal target material, a tank, a filter, and a nozzle. The tank may be configured to store the metal target. The filter may be configured to suppress passage of particles in the metal target stored in the tank. The nozzle may be provided with a nozzle hole. The nozzle may be configured to eject, from the nozzle hole, the metal target that has passed through the filter. The control unit may be configured to control the heater such that the target supply device becomes a first temperature, and may be configured to control the pressure adjuster and the exhaust device such that a gas pressure in the tank becomes higher than a gas pressure in the chamber.

A processing device according to still another aspect of the present disclosure may be a processing device for a target supply device. The target supply device may be configured to supply a metal target in a plasma generation region. The processing device may include a chamber, an inactive gas supplying unit, a target supply device, a heater, an exhaust device, and a control unit. The inactive gas supplying unit may be configured to supply an inactive gas in an inside of the chamber. The target supply device may be provided in the chamber. The target supply device may include a tank. The tank may be configured to store the metal target. The heater may be configured to heat the target supply device. The exhaust device may be configured to exhaust the inside of the tank. The control unit may be configured to control the heater, the exhaust device, and the inactive gas supplying unit. The target supply device may further include a metal target material, a filter, and a nozzle. The filter may be configured to suppress passage of particles in the metal target stored in the tank. The nozzle may be provided with a nozzle hole. The nozzle may be configured to eject, from the nozzle hole, the metal target that has passed through the filter. The control unit may control the heater such that the target supply device becomes a first temperature. The control unit may control the inactive gas supplying unit and the exhaust device such that a gas pressure in the tank becomes lower than a gas pressure in the chamber.

A processing method according to still another aspect of the present disclosure may be a processing method for a target supply device. The target supply device may be configured to supply a metal target in a plasma generation region. The processing method may include etching oxides generated on a surface of the metal target, dehydrating a tank configured to store the metal target, dehydrating a filter configured to suppress passage of particles in the metal target stored in the tank, and dehydrating a nozzle provided with a nozzle hole. The nozzle may be configured to eject, from the nozzle hole, the metal target that has passed through the filter.

A processing method according to still another aspect of the present disclosure may be a processing method for a target supply device. The target supply device may include a tank, a filter, and a nozzle. The tank may be configured to store a metal target. The filter may be configured to suppress passage of particles in the metal target stored in the tank. The nozzle may be provided with a nozzle hole. The nozzle may be configured to eject, from the nozzle hole, the metal target that has passed through the filter. The processing method may include causing an inactive gas to flow in an inside of the tank in a state where the metal target is stored in the tank, and heating the target supply device to become a first temperature equal to or higher than a temperature at which water components adsorbed in the target supply device are separated from the target supply device and lower than a melting point of the metal target.

A processing method according to still another aspect of the present disclosure may be a processing method for a target supply device. The target supply device may include a tank, a filter, and a nozzle. The tank may be configured to store a metal target. The filter may be configured to suppress passage of particles in the metal target stored in the tank. The nozzle may be provided with a nozzle hole. The nozzle may be configured to eject, from the nozzle hole, the metal target that has passed through the filter. The processing method may include heating the target supply device to become a first temperature equal to or higher than a temperature at which water components adsorbed in the target supply device are separated from the target supply device and lower than a melting point of the metal target in a state where the metal target is stored in the tank, and performing filling and exhausting of an inactive gas into and from the tank one or more times in a state where the target supply device is heated to the first temperature.

BRIEF DESCRIPTION OF THE DRAWINGS

Embodiments of the present disclosure will now be described with reference to attached drawings as illustrative only.

FIG. 15 is a table of an example of a baking condition according to the embodiment;

EMBODIMENTS

Contents

Figure 1:
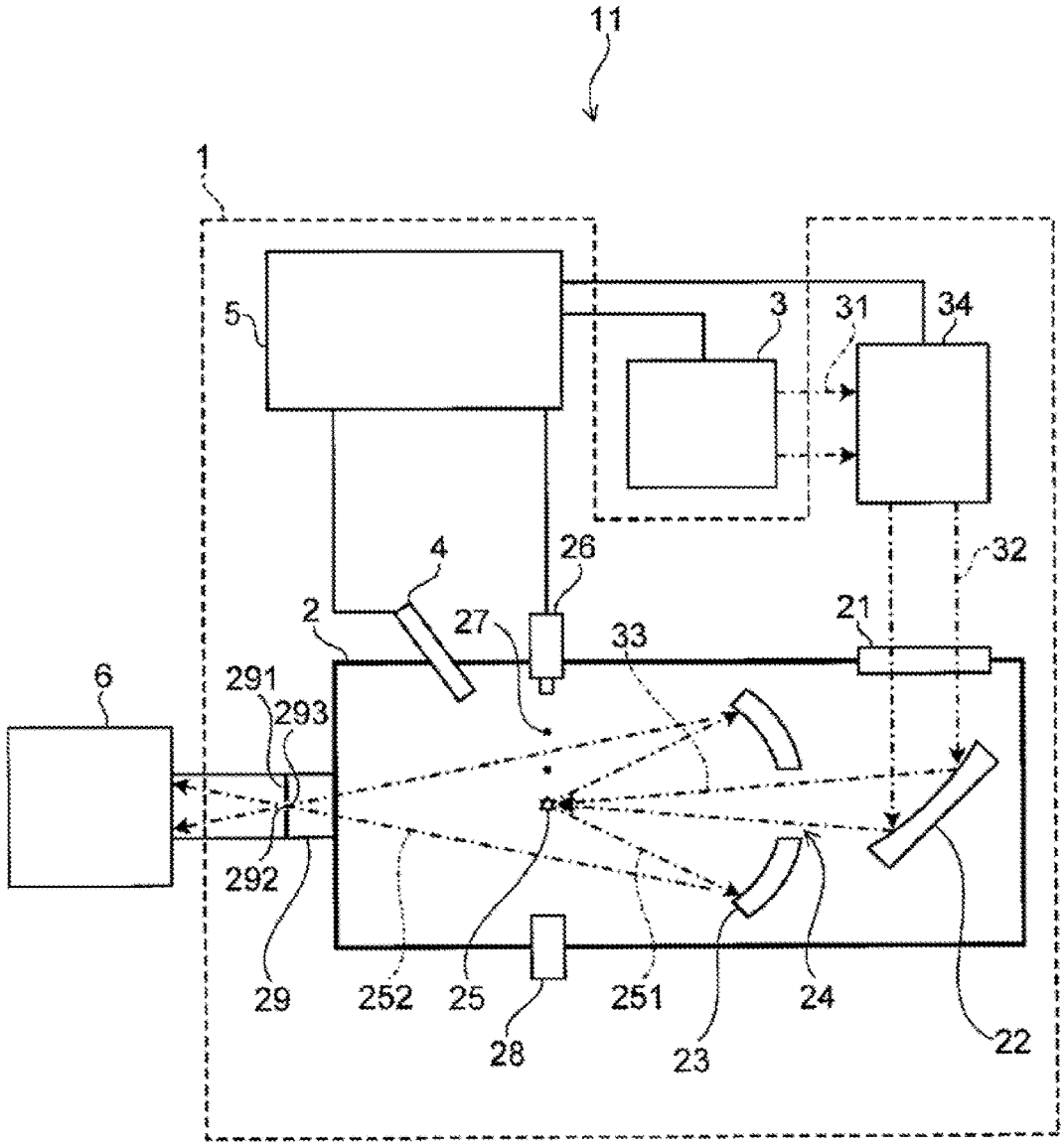
FIG. 1 is a diagram schematically illustrating a configuration of an illustrative LPP EUV light generation system.

1. Overview
2. Terms
3. General description of Extreme ultraviolet light generation device
   3.1 Configuration
   3.2 Operation
4. Target supply unit mounted on Extreme ultraviolet light generation device
   4.1 Configuration
   4.2 Operation
   4.3 Problem to be solved
5. Structure of Target supply unit and Baking process
   5.1 Structure of Target supply unit
   5.2 Shape of Ingot
   5.3 Baking process of Target supply unit and Components thereof
   5.4 Effect
6. Baking processing device of Target supply unit
   6.1 Configuration
   6.2 Operation
   6.3 Effect
   6.4 Variation of Baking processing device
   6.4.1 Modification 1
      6.4.1.1 Configuration
      6.4.1.2 Operation
      6.4.1.3 Effect
   6.4.2 Modification 2
      6.4.2.1 Configuration
      6.4.2.2 Operation
      6.4.2.3 Effect 7. EUV light generation device including Baking processing device of Target supply unit
7.1 Configuration
7.2 Operation
7.3 Effect
7.4 Variation in EUV light generation device in which Baking processing device is incorporated
7.4.1 Configuration
7.4.2 Operation
7.4.3 Effect
8. Others
8.1 Other example of Dehydration process
8.2 Control unit Hereinafter, embodiments of the present disclosure will be described in detail with reference to the drawings. The embodiments to be described below are to be taken as merely examples of the present disclosure and do not limit a scope of the present disclosure. In addition, not all configurations and operations to be described in the respective embodiments may not be essential to configuration and operation of the present disclosure. It should be noted that identical components are denoted as identical reference numerals and overlaps between their descriptions will be omitted.

1. Overview

An embodiment of the present disclosure may relate to a target supply device (also referred to as "target supply unit") in an EUV light generation device, and a processing device configured to perform a processing concerning the target supply device and a processing method thereof. More particularly, the embodiment of the present disclosure may relate to a device and a method for executing a dehydration process of the target supply device, and the target supply device dehydrated by the processing device and the processing method. It should be noted that the present disclosure should not be limited to these matters and may relate to any matters for supplying a target material in a form of a droplet. Further, hereinafter, a baking process will be described as one example of the dehydration process, but does not exclude use of another dehydration process.

2. Terms

The terms used in the present disclosure are defined as follows.

A "droplet" may be a liquid drop of a dissolved target material. A shape of the droplet may be approximately spherical.

A "plasma generation region" may be a three-dimensional space predetermined as a space where plasma is to be generated.

3. General Description of EUV Light Generation System

3.1 Configuration

FIG. 1 schematically illustrates a configuration of an illustrative LPP EUV light generation system. An EUV light generation device 1 may be used with at least one laser apparatus 3. In this application, a system including the EUV light generation device 1 and the laser apparatus 3 is referred to as an EUV light generation system 11. As illustrated in FIG. 1 and as hereinafter described in detail, the EUV light generation device 1 may include a chamber 2 and a target supply unit 26. The chamber 2 may be hermetically sealable. The target supply unit 26 may be attached, for example, to penetrate through a wall of the chamber 2. A material of target substances to be supplied from the target supply unit 26 may be tin, terbium, gadolinium, lithium, xenon, or any combination of two or more of them, but is not limited to the above.

The wall of the chamber 2 may have at least one through hole. The through hole may be provided with a window 21 and pulse laser beam 32 from the laser apparatus 3 may pass through the window 21. For example, an EUV focusing mirror 23 having a spheroidal reflective surface may be arranged in an inside of the chamber 2. The EUV focusing mirror 23 may have first and second focuses. For example, a multi-layer reflective film with alternating molybdenum and silicon layers may be formed on a surface of the EUV focusing mirror 23. For example, the first focus of the EUV focusing mirror 23 is preferably located in a plasma generation region 25 and the second focus of the EUV focusing mirror 23 is preferably located at an intermediate light focusing point (IF) 292. A through hole 24 may be provided in a center of the EUV focusing mirror 23 and pulse laser beam 33 may pass through the through hole 24.

The EUV light generation device 1 may include an EUV light generation controller 5, a target sensor 4, and other components. The target sensor 4 may have an imaging function and be configured to detect a presence, path, position, speed, or other information on the target 27.

The EUV light generation device 1 may further include a connecting portion 29 that establishes communication between the inside of the chamber 2 and an inside of an exposure device 6. A wall 291 with an aperture 293 may be provided in an inside of the connecting portion 29. The wall 291 may be disposed so that the aperture 293 is located in a position of the second focus of the EUV focusing mirror 23.

The EUV light generation device 1 may further include a laser beam travel direction control unit 34, a laser beam focusing mirror 22, a target recovery unit 28 for recovery of the target 27, and the like. The laser beam travel direction control unit 34 may include an optical element configured to define a travel direction of the laser beam, and an actuator configured to adjust a position, posture, and the like of the optical element.

3.2 Operation

As illustrated in FIG. 1, a pulse laser beam 31 emitted from the laser apparatus 3 may pass through the laser beam travel direction control unit 34 and then enter the inside of the chamber 2 through the window 21 as a pulse laser beam 32. The pulse laser beam 32 may travel to the inside of the chamber 2 along at least one laser beam path and then be reflected by the laser beam focusing mirror 22, and be radiated to at least one target 27 as a pulse laser beam 33.

The target supply unit 26 may be configured to output the target 27 at the plasma generation region 25 in the chamber 2. The target 27 may be irradiated with at least one pulse included in the pulse laser beam 33. The target 27 irradiated with the pulse laser beam is turned into plasma that can generate emitted light 251. EUV light 252 contained in the emitted light 251 may be selectively reflected by the EUV focusing mirror 23. The EUV light 252 reflected by the EUV focusing mirror 23 may be focused at the intermediate light focusing point 292 and then outputted to the exposure device 6. It should be noted that one target 27 may be irradiated with a plurality of pulses contained in the pulse laser beam 33.

The EUV light generation controller 5 may be configured to control the entire EUV light generation system 11. The EUV light generation controller 5 may be configured to process image data or the like of the target 27 captured by the target sensor 4. Further, the EUV light generation controller 5 may be configured to control a timing and a direction of the ejection of the target 27, for example. Moreover, the EUV light generation controller 5 may be configured to control an oscillation timing of the laser apparatus 3, a travel direction of the pulse laser beam 32, and a focusing position of the pulse laser beam 33, for example. The aforementioned various types of control are examples. Other types of control may be added as required.

4. Target Supply Unit Mounted on Extreme Ultraviolet Light Generation Device

Subsequently a target supply unit (also referred to as "target supply device") mounted on the EUV light generation device will be described in more detail.

4.1 Configuration

Figure 2:
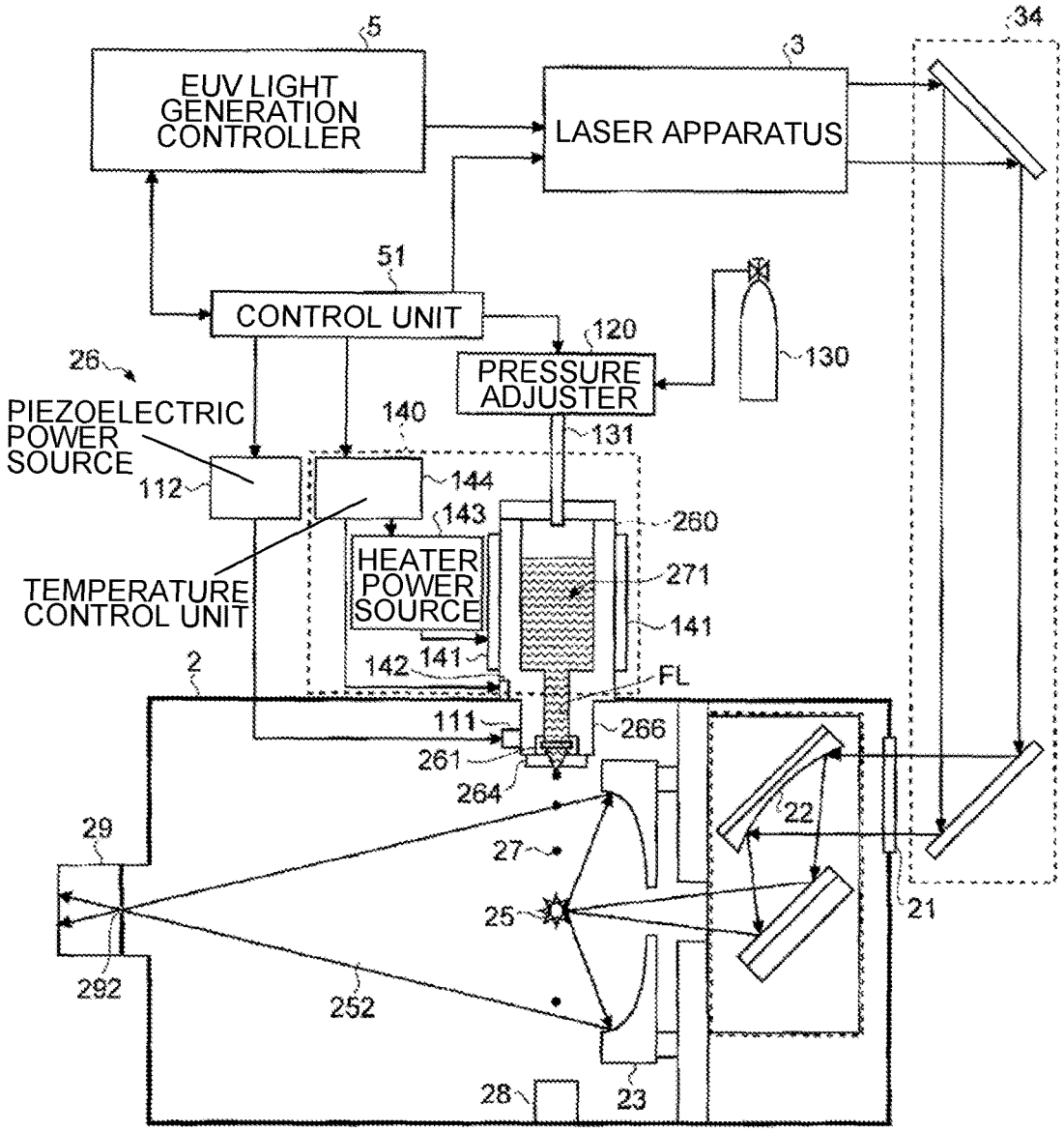
FIG. 2 is a schematic diagram more specifically illustrating an example of a target supply unit mounted in an EUV light generation device illustrated in FIG. 1.
Figure 3:
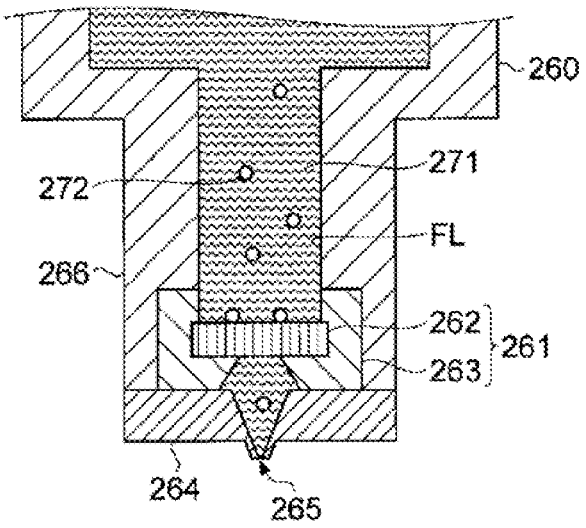
FIG. 3 is a cross-sectional view of an example of a schematic configuration in a circumference of a filter portion in FIG. 2.

FIG. 2 is a schematic diagram of an example of the target supply unit mounted on the EUV light generation device in more detail. FIG. 3 is a cross-sectional view of an example of a schematic configuration in a circumference of a filter portion in FIG. 2. It should be noted that, in FIG. 2, a part of a configuration other than the target supply unit is different from the configuration described using FIG. 1, but this should not be construed to limit a scope of the present disclosure. Various configurations in addition to the configuration described using FIG. 1 may be applied to the configurations other than the target supply unit. FIG. 3 illustrates one example of a sectional structure on a plane along a movement direction of a target material 271 flowing in a target flow passage FL.

As illustrated in FIG. 2, the target supply unit 26 may include a pressure adjuster 120, a temperature-controllable device 140, a control unit 51, and a piezoelectric power source 112.

The target supply unit 26 may include a tank unit 260, a filter portion 261, a nozzle portion 264, and a piezoelectric element 111.

The tank unit 260 may include a tank provided with a space in an inside of the tank and a lid configured to seal the space. The target material 271 may be stored in the space in the tank unit 260. The target material 271 may be a metal material of tin (Sn) or the like. A protrusion 266 configured to cause the nozzle portion 264 to protruded into a chamber 2 (refer to FIG. 1) may be provided in a downstream side of the tank unit 260 in a movement direction of the target material 271. This protrusion 266 may be formed integrally with or independently of the tank unit 260.

As illustrated in FIG. 2 and FIG. 3, the target flow passage FL may be formed in an inside of the protrusion 266 for the dissolved target material 271 to pass from the inside of the tank unit 260 to the nozzle portion 264. Accordingly, the target flow passage FL may be communicated with the space in the tank unit 260 and with a nozzle hole 265 to be described later.

The materials for the tank unit 260 including the protrusion 266 may have low reactivity with the target material 271. This material having low reactivity with the target material 271 may be molybdenum (Mo), for example.

The nozzle portion 264 may be provided in the protrusion 266 to cover an opening at a lower surface of the protrusion 266. The nozzle portion 264 may have a nozzle hole 265. A hole diameter of the nozzle hole 265 may be, for example, 2 to 6 μm. The material for the nozzle portion 264 may be molybdenum (Mo).

The filter portion 261 may be arranged in the target flow passage FL between the tank unit 260 and the nozzle portion 264. A diameter enlarged portion for housing the filter portion 261 may be formed in the target flow passage FL between the tank unit 260 and the nozzle portion 264. The filter portion 261 may be housed in the diameter enlarged portion with no gap.

The filter portion 261 may include a filter 262 and a filter holder 263. The filter 262 may filter particles 272 of tin oxides, impurities and the other components. This filter 262 may be formed of a porous material. The porous material may be porous glass. The porous glass may be a glass porous body including aluminum oxide-silicon dioxide glass as a skeleton. A hole diameter of the porous may be 3 to 10 μm. The filter 262 may have a structure made of lamination of a plurality of porous plate-shaped members.

A part or all of the porous members may be replaced by members formed of a bundle of capillary tubes with arrayed openings. A hole diameter of the capillary tube may be approximately 0.1 to 2 μm. The capillary tube may be made of glass.

In addition, as illustrated in FIG. 2, the pressure adjuster 120 may be connected to a gas cylinder 130 of inactive gases through a gas pipe. The inactive gas may be argon (Ar) gas, helium (He) gas, nitrogen gas or the like. The gas cylinder 130 may be provided with a valve that adjusts a supply pressure of inactive gases to be supplied. The inactive gases supplied from the gas cylinder 130 may be introduced in a space in the tank unit 260 through an introduction tube 131 from the pressure adjuster 120. The pressure adjuster 120 may have an operation of exhausting the gases in the tank unit 260.

A temperature-controllable device 140 may include a heater 141, a temperature sensor 142, a heater power source 143, and a temperature control unit 144.

The temperature control unit 144 may be connected to the temperature sensor 142 and the heater power source 143. The temperature sensor 142 may be arranged to measure a temperature of the tank unit 260 or the target material 271 in the tank unit 260. The heater power source 143 may be connected electrically to the heater 141. The heater power source 143 may supply current to the heater 141 according to control from the temperature control unit 144. The heater 141 may be arranged to heat the target material 271 in the tank unit 260. For example, the heater 141 may be arranged on an outer lateral surface of the tank unit 260.

The piezoelectric power source 112 may be connected to the control unit 51 and the piezoelectric element 111. The piezoelectric element 111 may be provided on a lateral surface of the protrusion 266.

The control unit 51 may be connected to the piezoelectric power source 112, the temperature control unit 144, the pressure adjuster 120, the EUV light generation controller 5 and the laser apparatus 3 to be capable of transmitting/receiving various kinds of signals.

Since the other configurations may be similar to the configurations illustrated in FIG. 1, the detailed description will be omitted.

4.2 Operation

Subsequently, schematic operations of the target supply unit 26 and the EUV light generation device 1 configured to mount the target supply unit 26 as illustrated in FIG. 2 and FIG. 3 will be described.

First, the control unit 51 may receive a target output preparation command from the EUV light generation controller 5. The target output preparation command may be a command for starting preparation for supplying the target material 271 into the chamber 2. Upon reception of the target output preparation command, the control unit 51 may output a command of temperature control to the temperature control unit 144.

The temperature control unit 144 may drive the heater power source 143 according to the received command to supply current to the heater 141 such that a temperature of the tank unit 260 or the target material 271 inside thereof is within a predetermined temperature range. "The predetermined temperature range" may be a temperature range equal to or higher than a melting point (for example, 231.9° C. that is a melting point of tin) of the target material 271, for example. Specifically, the predetermined temperature range may be a temperature range of 250° C. or higher and 300° C. or lower, for example.

The temperature control unit 144 may control the heater power source 143 based upon a temperature detected by the temperature sensor 142 such that the temperature of the tank unit 260 or the target material 271 inside thereof is maintained within the predetermined temperature range.

Thereafter, a target output command is input to the control unit 51 from the EUV light generation controller 5. The target output command may be a command for supplying the target material 271 into the chamber 2. Upon reception of the target output command, the control unit 51 may output a command of the pressure control to the pressure adjuster 120.

The pressure adjuster 120 may increase a pressure in the inside of the tank unit 260 according to the received command to pressurize the target material 271. The increased gas pressure in the tank unit 260 may be, for example, a pressure which allows the dissolved target material 271 to be ejected in a jet shape from the nozzle hole 265. The pressure adjuster 120 may control the gas pressure in the tank unit 260 in such a manner as to maintain the pressure which allows the target material 271 to be ejected in the jet shape from the nozzle hole 265.

The pressurized liquid-shaped target material 271 may be filtered by the filter portion 261 upon passing through the target flow passage FL. Thereby particles 272 of tin oxides, impurities and the other components contained in the target material 271 may be filtered/removed by the filter 262. As a result, the target material 271 from which the particles 272 causing clogging or the like are removed can be supplied to the nozzle portion 264.

Further, the control unit 51 having received the target output command may drive the piezoelectric power source 112 to vibrate the piezoelectric element 111 such that oscillations having a predetermined waveform and a predetermined frequency are transmitted to the nozzle hole 265. Thereby the jet of the target material 271 to be ejected from the nozzle hole 265 can be divided into droplet-shaped targets 27 having a predetermined size and a predetermined cycle.

The droplet-shaped target 27 may be irradiated with pulse laser beam 33 upon reaching the plasma generation region 25. EUV light 252 can be emitted from the target 27 that has been generated as the plasma by irradiation with the pulse laser beam 33. The emitted EUV light 252 is focused on the intermediate light focusing point 292 by the EUV focusing mirror 23, and thereafter, may be input to the exposure device 6 (refer to FIG. 1).

4.3 Problem to be Solved

With the above illustrative configuration, it is possible to remove the particles 272 of tin oxides, impurities and the other components existing in the target material 271 before passing through the filter portion 261. However, the particles of tin oxides or the like may be generated at the time of and after passing through the filter portion 261. One of the causes is assumed to be that water components and the like adsorbed on the surface of holes in the filter 262 and on member surfaces from the filter portion 261 to the nozzle hole 265 react with the target material to generate tin oxides.

The particles 272 generated in the target material 271 after passing through the filter portion 261 can reach to the nozzle hole 265. The particles 272 having reached the nozzle hole 265 can clog the nozzle hole 265. The particles 272 possibly reduce a hole diameter of the nozzle hole 265 to cause a target track to be changed. In this way, the particles 272 having reached the nozzle hole 265 possibly interrupt stable supply of the target 27.

Therefore, in the following embodiment, a target supply device that can reduce the particles 272 possibly reaching the nozzle hole 265, and a processing device and a processing method therefor are described as examples.

5. Structure of Target Supply Unit and Baking Process

First, the structure of the target supply unit and the process of the baking process thereof according to the embodiment will be described in detail with reference to the drawings.

5.1 Structure of Target Supply Unit

Figure 4:
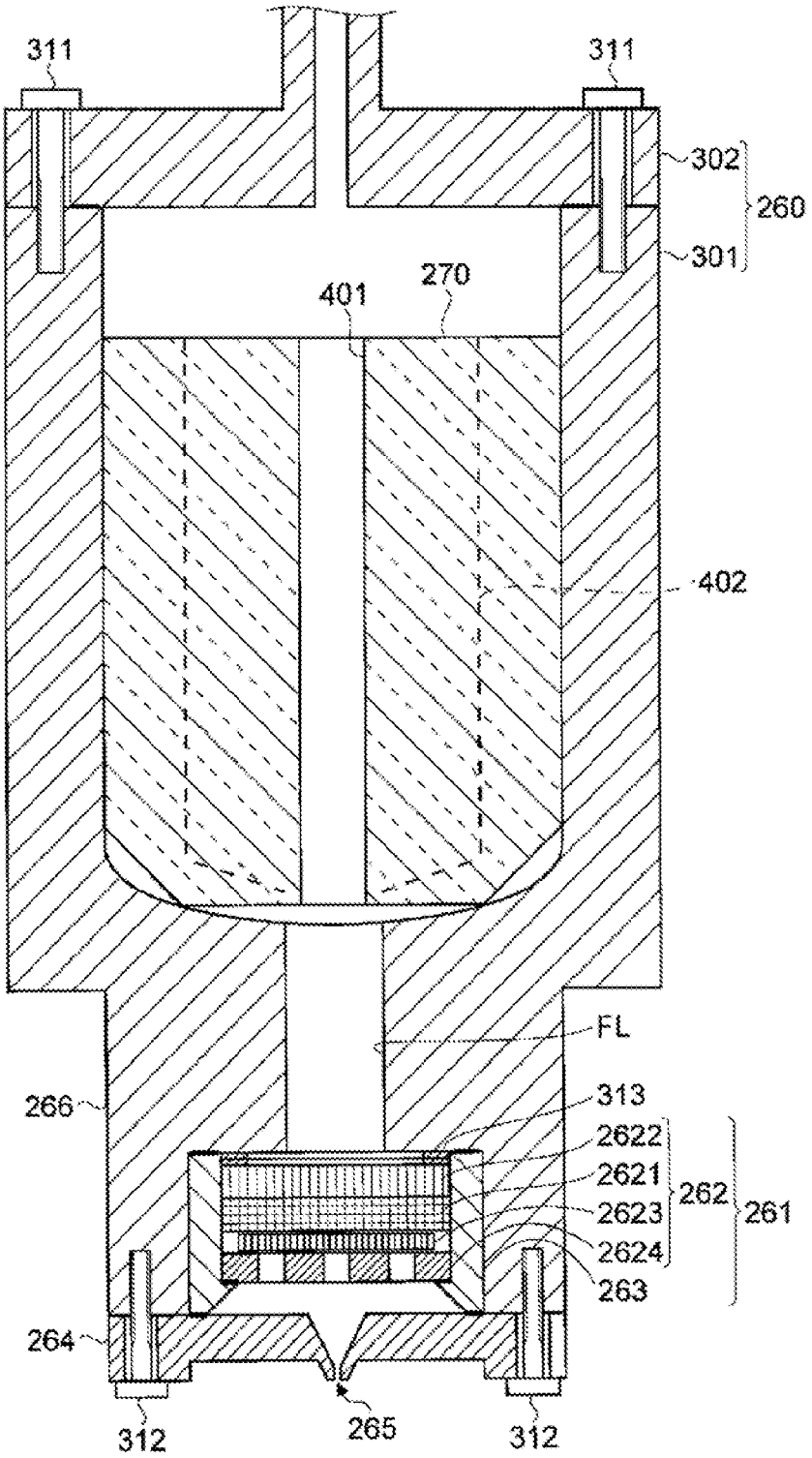
FIG. 4 is a cross-sectional view of an example of a structure in a circumference of a tank unit and a nozzle portion in a target supply unit according to an embodiment.

The structure of the target supply unit according to the embodiment may be similar to that of the aforementioned target supply unit 26. Therefore, FIG. 4 illustrates a structure of a part of the target supply unit 26 as an example of a schematic structure of a part of the target supply unit according to the embodiment. FIG. 4 illustrates the structure in a circumference of the tank unit 260 and the nozzle portion 264 in the target supply unit 26.

As illustrated in FIG. 4, the tank unit 260 in the target supply unit 26 may include a tank 301 provided with a space in an inside of the tank 301 and a lid 302 that seals the space. The materials for the tank 301 and the lid 302 may be, as described above, a material having low reactivity with the target material 271, for example, molybdenum (Mo).

The tank 301 and the lid 302 may be fixed using bolts 311, for example. In a state where the tank 301 and the lid 302 are fixed, the space in the tank 301 may be sealed by a face seal formed with the tank 301 and the lid 302. However, the lid 302 may be provided with an introduction tube 131 communicated with the pressure adjuster 120.

The nozzle portion 264 may be fixed on the protrusion 266 of the bottom portion in the tank 301 using bolts 312. The target flow passage FL may be provided in the inside of the protrusion 266 to establish communication between the space in the tank 301 and the nozzle hole 265. The filter portion 261 may be housed in the diameter enlarged portion of the target flow passage FL.

In the filter portion 261, the filter 262 may include a first filter 2621, a second filter 2622, a third filter 2623, and a filter support body 2624.

The first filter 2621 may be a porous filter having a hole diameter of which is approximately 10 μm, for example. This porous filter may be a glass porous body including aluminum oxide-silicon dioxide glass incorporated as a skeleton.

The second filter 2622 may be a porous filter having a hole diameter of which is approximately 3 μm, for example. This porous filter may be a glass porous body including aluminum oxide-silicon dioxide glass incorporated as a skeleton.

The third filter 2623 may have the structure formed of a bundle of glass capillary tubes having a hole diameter of approximately 0.1 to 2 μm, for example. A dimension of the third filter 2623 may have a diameter of approximately 20 mm and a thickness of approximately 0.5 mm, for example. A material for each of the capillary tubes may be low-melting point glass containing lead (Pb). A section of the capillary tube in contact with the target material 271 may be coated with aluminum oxide.

The material for the filter support plate 2624 may be a material having low reactivity with the target material 271, for example, molybdenum (Mo). The filter support plate 2624 may be provided with a plurality of through holes through which the target material 271, having passed through the first to third filters 2621 to 2623, further passes. The number of the through holes may be approximately 10 to 40. A hole diameter of the through hole may be approximately 1 to 2 mm.

This filter 262 may be housed in the diameter enlarged portion in the target flow passage FL with no clearance using a filter holder 263 and shims 313. The material for the filter holder 263 may be a material having low reactivity with the target material 271, for example, molybdenum (Mo). The filter holder 263 may be provided with a barb for preventing a dropout of the filter portion 261.

The shim 313 may be a member that fills a clearance formed between the filter portion 261 and an inner wall of the protrusion 266 in a state where the filter holder 263 is set in the diameter enlarged portion in the target flow passage FL. The material for the shim 313 may be a material having low reactivity with the target material 271, for example, molybdenum (Mo).

In a state of fixing the nozzle portion 264 on the bottom portion of the protrusion 266 using the bolts 312, a face seal may be formed in a contact section between the filter holder 263 and the nozzle portion 264. In this state, a face seal may be formed in a contact section between the filter holder 263 and the inner wall of the protrusion 266.

In the above description, the face seal formed between members made of the same metal material (for example, Mo) may be a metal face seal.

The first filter 2621 and the second filter 2622 may be porous ceramics that have difficulty reacting with the liquid target material 271 (for example, liquid tin). An example of the porous ceramics may include, in addition to the above, aluminum oxide, silicon carbide, tungsten carbide, aluminum nitride and boron carbide.

In FIG. 4, a case where the filter 262 includes the plurality of filters (first to third filters 2621 to 2623) is described as an example, but the filter 262 may be configured to include one filter. In this case, for example, a filter of alumina ceramics may be used as the one filter configuring the filter 262.

The material for the nozzle portion 264 is not limited to molybdenum (Mo), but may be Pyrex (registered trade mark) glass, a synthetic quartz glass material or the like.

5.2 Shape of Ingot

In FIG. 4, an ingot 270 of the target material 271 may be housed in the space of the tank 301. Through holes, grooves or the like may be formed in the ingot 270 not to block off a passage of gases from the nozzle hole 265 to the introduction tube 131 in a state where the ingot 270 is housed in the space of the tank unit 260.

Figure 5:
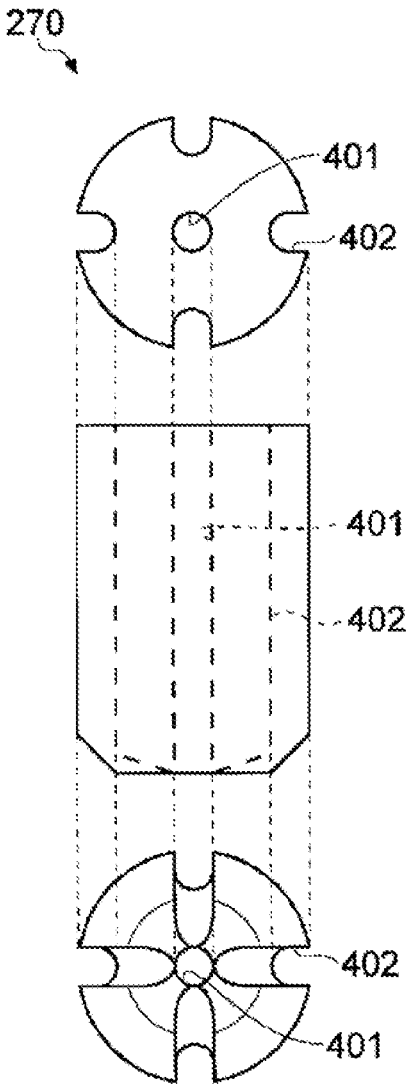
FIG. 5 is a diagram of a schematic shape of an ingot according to the embodiment.

FIG. 5 is a diagram illustrating a schematic shape of the ingot according to the embodiment. As illustrated in FIG. 5, the ingot 270 may be shaped such that one or more through holes 401 and one or more grooves 402 are formed in a cylindrical shape. The through hole 401 may penetrate from an upper surface to a bottom surface of the ingot 270. The groove 402 may traverse longitudinally on a lateral face of the ingot 270 and may be formed to the vicinity of the center of the bottom surface.

Figure 6:
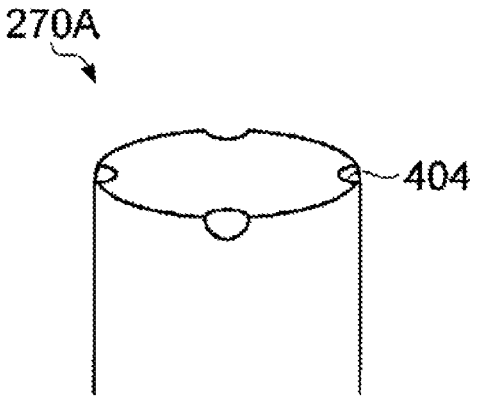
FIG. 6 is a diagram of a schematic shape of another ingot according to the embodiment.
Figure 7:
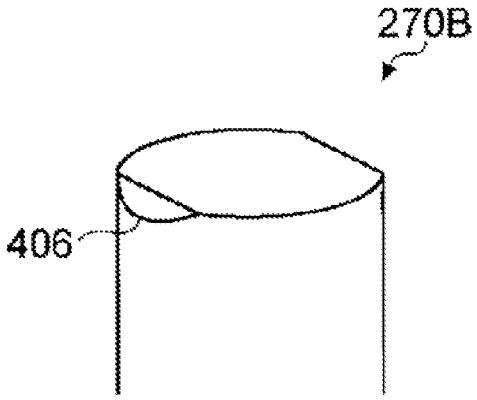
FIG. 7 is a diagram of a schematic shape of still another ingot according to the embodiment.

FIG. 6 and FIG. 7 are diagrams each illustrating a schematic shape of another ingot according to the embodiment. A diameter of each of ingots 270A, 270B illustrated in FIG. 6 and FIG. 7 is made smaller on some extent than a diameter of the space in the tank unit 260. In this case, as illustrated in FIG. 6 and FIG. 7, one or more notch portions 404 or 406 can be formed in a corner portion in a cylindrical shape, and thereby it is possible to secure the passage of gases from the nozzle hole 265 to the introduction tube 131.

5.3 Baking Process for Target Supply Unit and Components Thereof

Subsequently the process of a baking process for the target supply unit and components thereof will be described in detail with reference to the drawings.

Figure 8:
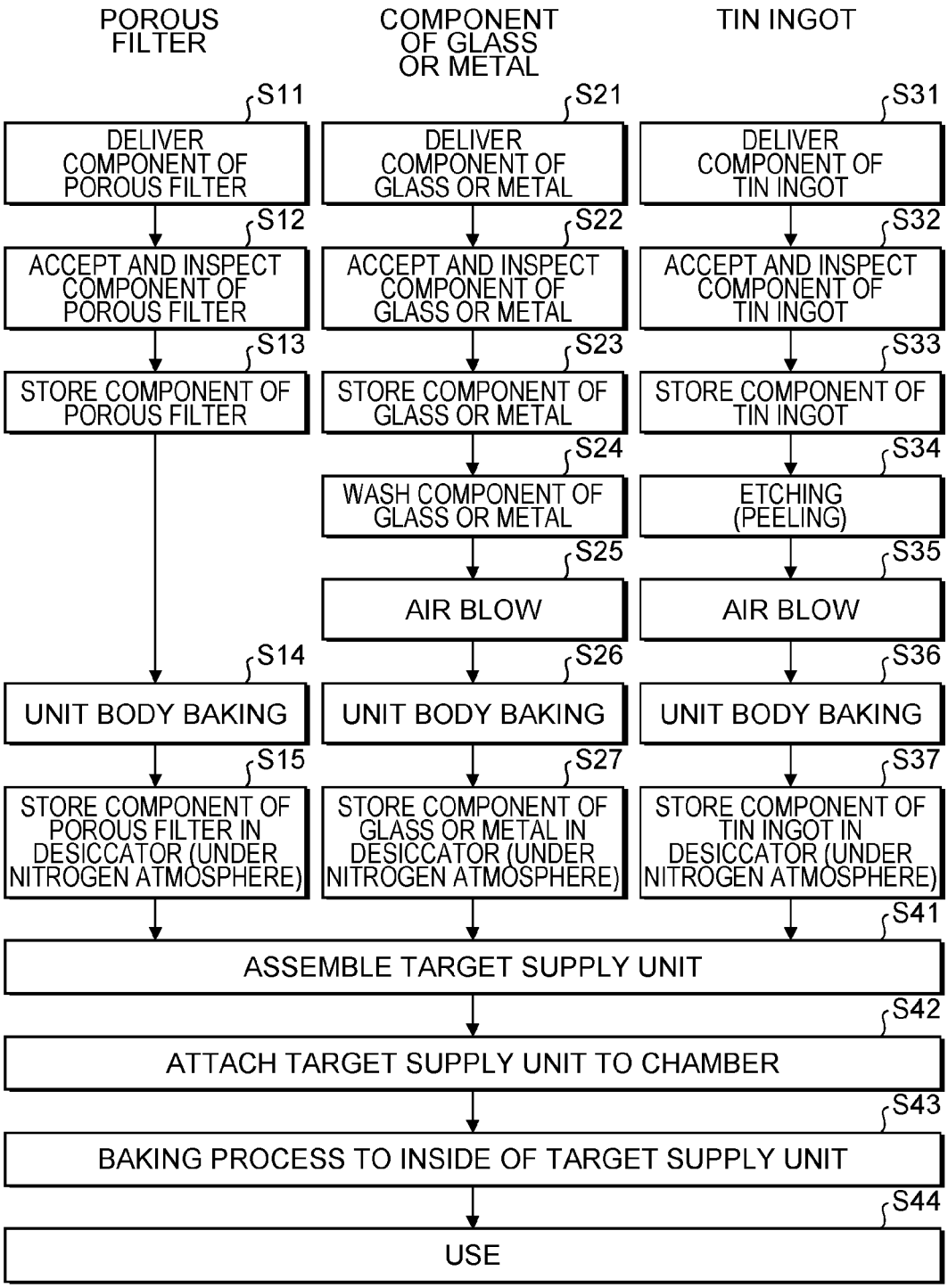
FIG. 8 is a flow chart of a baking process for the target supply unit and components thereof according to the embodiment.

FIG. 8 is a flow chart of the process of the baking process for the target supply unit and components thereof according to the embodiment. The flow chart illustrated in FIG. 8 illustrates a state from a point of starting with delivery of components configuring the target supply unit 26 to a point where the assembled target supply unit 26 becomes usable.

FIG. 8 illustrates porous filters, component of glass or metal and an ingot as an example of the components configuring the target supply unit 26, which are not limited thereto. It should be noted that the porous filters may include configuration components of the filter portion 261 such as porous glass (for example, a glass porous body including aluminum oxide-silicon dioxide glass as a skeleton), a ceramic filter (alumina porous filter), and the like. The glass components may include configuration components of the filter portion 261 such as a glass capillary tube array a hole diameter of which is approximately 0.1 to 2 and the like. In addition, the glass component may include the nozzle portion 264, for example, in a case where the nozzle portion 264 is made of glass. The metal components may include, for example, the tank unit 260, the filter holder 263, the shim 313 and the like. Further, the metal components may include the nozzle portion 264 in a case where the nozzle portion 264 is made of metal.

As illustrated in FIG. 8, in regard to the porous filter, a component of porous filter may be delivered (step S11), then may be subjected to an acceptance inspection (step S12), and may be stored in a predetermined storage place (step S13). The predetermined storage place may be a space that is managed in a constant temperature range of a relatively low temperature. Thereafter, the porous filter may be subjected to the baking process in a unit body (hereinafter, referred to as "unit body baking") to remove water components on a surface of the porous filter (step S14), and thereafter, may be stored in a desiccator under a nitrogen environment or the like (step S15).

In addition, in regard to the component of glass or metal, the component of glass or metal may be delivered (step S21), then may be subjected to an acceptance inspection (step S22), and may be stored in a predetermined storage place (step S23). Thereafter, the component of glass or metal may be subjected to washing treatment (step S24) and water droplets on a surface of the component may be removed by air blow (step S25), water components on the surface may be removed by the unit body baking (step S26), and thereafter, may be stored in a desiccator under a nitrogen environment or the like (step S27).

In addition, in regard to the ingot, the ingot may be delivered (step S31), then may be subjected to an acceptance inspection (step S32), and may be stored in a predetermined storage place (step S33). Thereafter, the ingot may be subjected to etching (peeling) treatment for removing oxides (tin oxides) formed on the surface (step S34) and water droplets on a surface of the ingot may be removed by air blow (step S35), water components on the surface may be removed by the unit body baking (step S36), and thereafter, may be stored in a desiccator under a nitrogen environment or the like (step S37).

Here, in the process of executing the unit body baking to each of the components, a clean oven in which a few particles are present in the space for thermal treatment may be used. An atmosphere in the oven may be an inactive gas such as nitrogen or argon. Instead, the process of executing the unit body baking may be performed under vacuum. Further, in a case where the component of a baking target is a porous filter, a glass component or a metal component, the atmosphere of the cleaning oven may be clean dried air or atmospheric air. A baking temperature may be, for example, 110° C. or higher and a temperature to the extent that the component is not damaged. The temperature may be, for example, 200° C. The baking time may be approximately six hours, for example.

In the etching (peeling) process of removing oxides on the surface of the ingot, the ingot, for example, after immersed in a mixed acid of a sulfuric acid and a nitric acid, may be subjected to the etching (peeling) process on the surface by a hydrochloric acid.

Each of the components stored in the desiccator or the like via the above process may be assembled as the target supply unit 26 thereafter (step S41). This assembling work is preferably carried out quickly in view of adhesion of water components or oxidation of the ingot surface. In the assembling work, an assembly of components such as the heater 141, the temperature sensor 142 and the piezoelectric element 111 (refer to FIG. 2) may be carried out.

The assembled target supply unit 26 is attached in the chamber (step S42), and the baking process to the inside of the target supply unit 26 may be executed in that state (step S43). The chamber where the attaching is performed may be a chamber 2 (refer to FIG. 2) in the EUV light generation device 1 or a chamber exclusive to the baking process.

Via the above steps, the target supply unit 26 may be in a usable state (step S44).

5.4 Effect

As described above, by executing the baking process to each of the components in the target supply unit 26, the water adsorbed on the component can be separated from the component. Particularly by executing the baking process to the porous filter a surface area of which is relatively large, a large deal of water adsorbed in the porous can be separated from the component.

By executing the baking process to the inside of the target supply unit 26 also after assembling it, an amount of water components that possibly make contact with the target material 271 can be further reduced.

Figure 9:
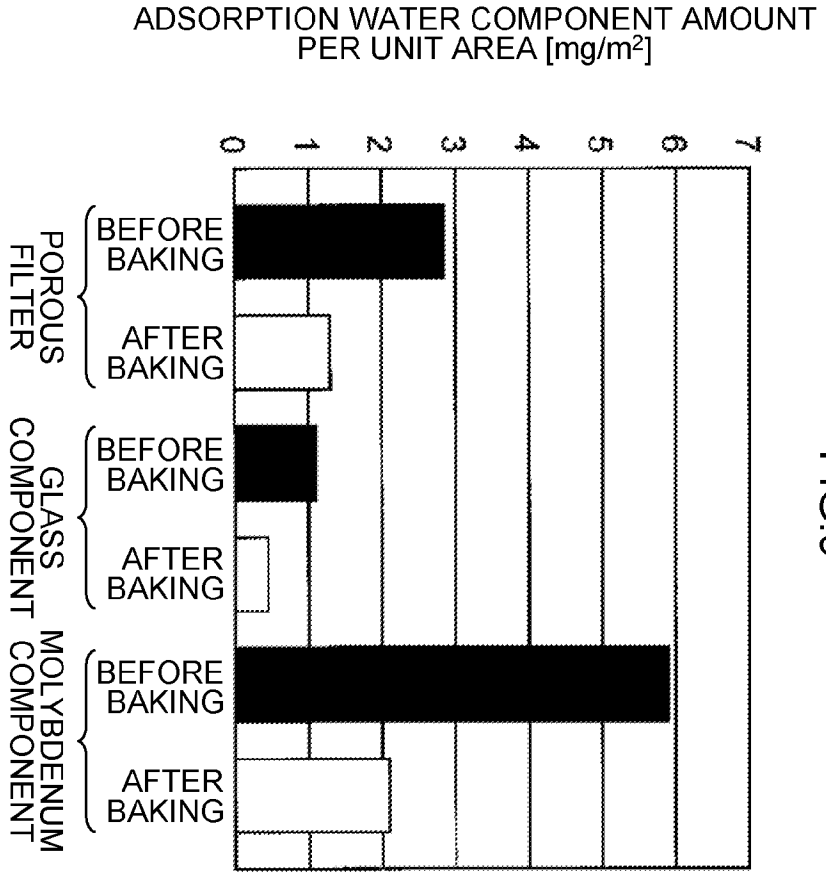
FIG. 9 is a graph of a measurement result of an adsorption water component amount per unit area before and after the baking process of each component in the target supply unit according to the embodiment.

Here, FIG. 9 illustrates a measurement result of an adsorption water component amount per unit area before and after the baking process of each component in the target supply unit 26. As illustrated in FIG. 9, by executing the baking process according to the embodiment, an adsorption water component amount per unit area of all the components in the target supply unit 26 was separated to a half or less of that before the baking process. For example, an adsorption water component amount per unit area of the porous filter surface after the baking process is equal to or less than 2 $mg/m^2$.

Figure 10:
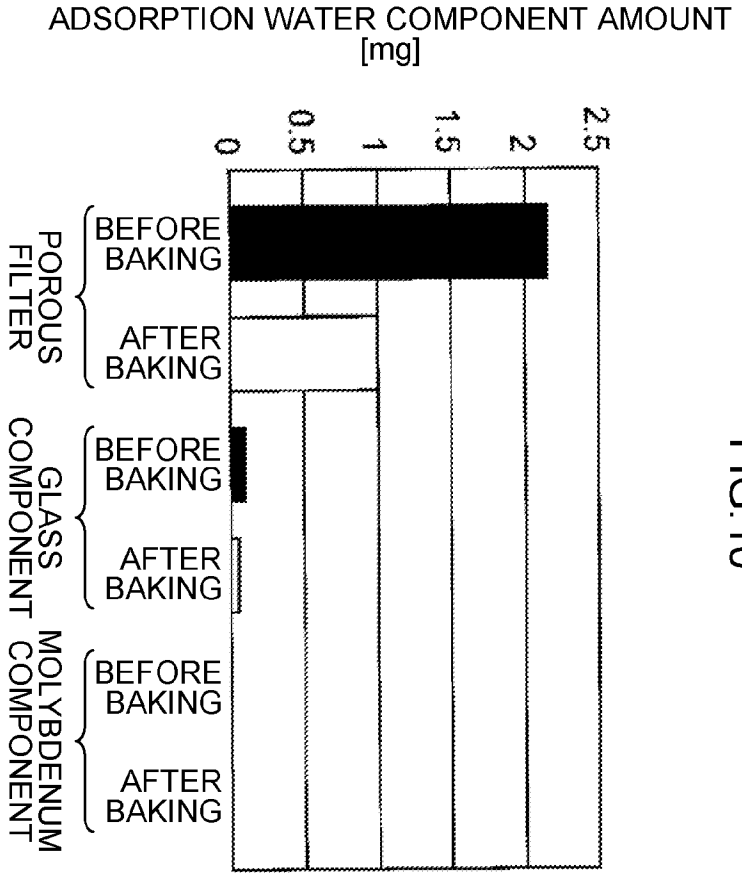
FIG. 10 is a graph of a measurement result of a total adsorption water component amount before and after the baking process in the target supply unit according to the embodiment.

FIG. 10 illustrates a measurement result of an adsorption water component amount before and after the baking process of each of the components in the target supply unit 26. As illustrated in FIG. 10, a large part of the total adsorption water component amount is occupied by the porous filter. By executing the baking process according to the embodiment, a half or more of the adsorption water component amount of the porous filter can be removed. From this point, it has been found out that particularly the baking process (dehydration process) of the porous filter is effective.

6. Baking Processing Device of Target Supply Unit

Subsequently, the baking processing device of the assembled target supply unit will be described in detail with reference to the drawings.

6.1 Configuration

Figure 11:
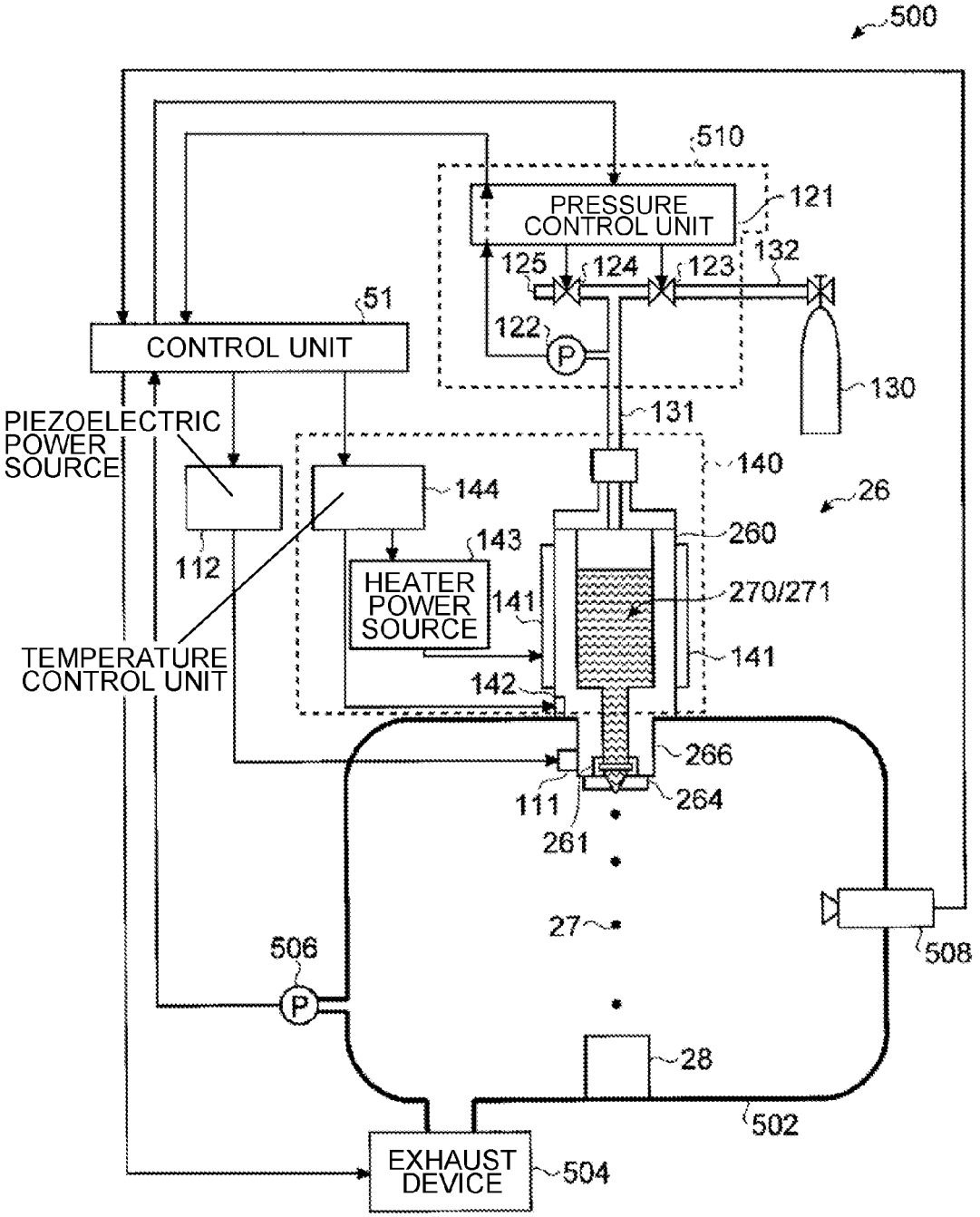
FIG. 11 is a schematic diagram of an example of a schematic configuration of a baking processing device according to the embodiment.

FIG. 11 is a schematic diagram of an example of a schematic configuration of the baking processing device according to the embodiment. In FIG. 11, components identical to those in FIG. 2 are referred to as identical reference numerals, and the detailed description will be omitted.

As illustrated in FIG. 11, a baking processing device 500 may be provided with the configuration in which the target supply unit 26 illustrated in FIG. 2 is attached in a chamber 502 for baking process. However, in the baking processing device 500, a pressure adjuster 510 may be used instead of the pressure adjuster 120.

The pressure adjuster 510 may include a gas pipe 132, two valves 123 and 124, a pressure sensor 122, and a pressure control unit 121. The gas pipe 132 may be connected to the gas cylinder 130. The two valves 123 and 124 may be provided in the gas pipe 132. The introduction tube 131 communicated with the tank unit 260 may be branched from between the two valves 123 and 124 in the gas pipe 132. One end of the gas pipe 132 may be used as an exhaust port 125.

The pressure sensor 122 may be provided in the introduction tube 131. A pressure value detected by the pressure sensor 122 may be input to the pressure control unit 121. The pressure control unit 121 may control opening/closing of the two valves 123 and 124.

A camera 508, an exhaust device 504 and a pressure sensor 506 may be attached to the chamber 502. A target recovery unit 28 may be provided in the chamber 502.

The camera 508 may be arranged in a position of being capable of imaging the droplet-shaped target 27 that is outputted from the nozzle portion 264 in the chamber 502. The pressure sensor 506 may be arranged in a position of being capable of measuring pressures in the inside of the chamber 502. A pressure value detected by the pressure sensor 506 may be input to the control unit 51. The exhaust device 504 may be arranged to be capable of exhausting gases in the inside of the chamber 502.

6.2 Operation

Subsequently the baking process using the baking processing device 500 illustrated in FIG. 11 will be described in detail with reference to the drawings.

Figure 12A:
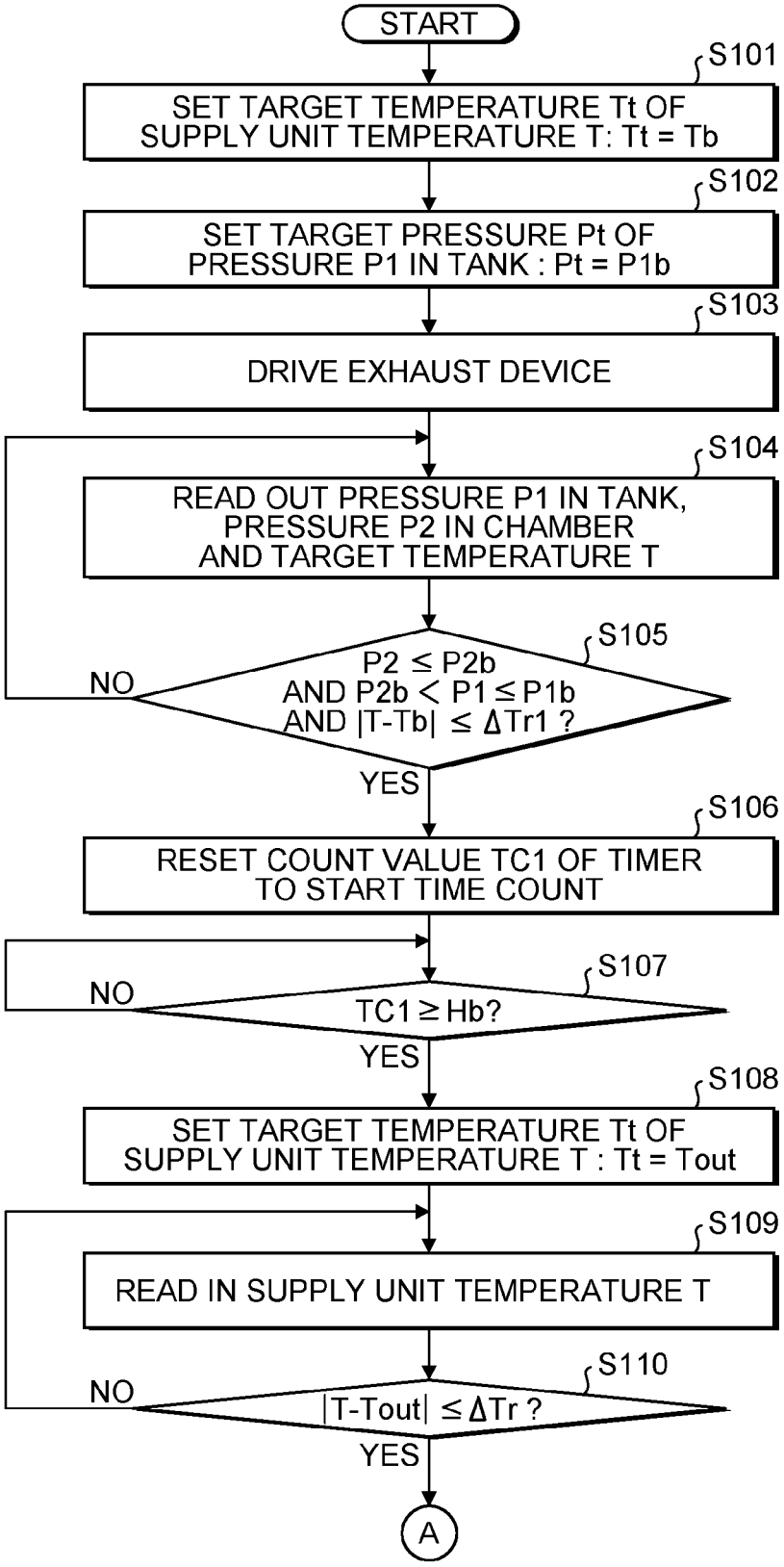
FIGS. 12A and 12B are flow charts of one example of the baking process according to the embodiment.
Figure 12B:
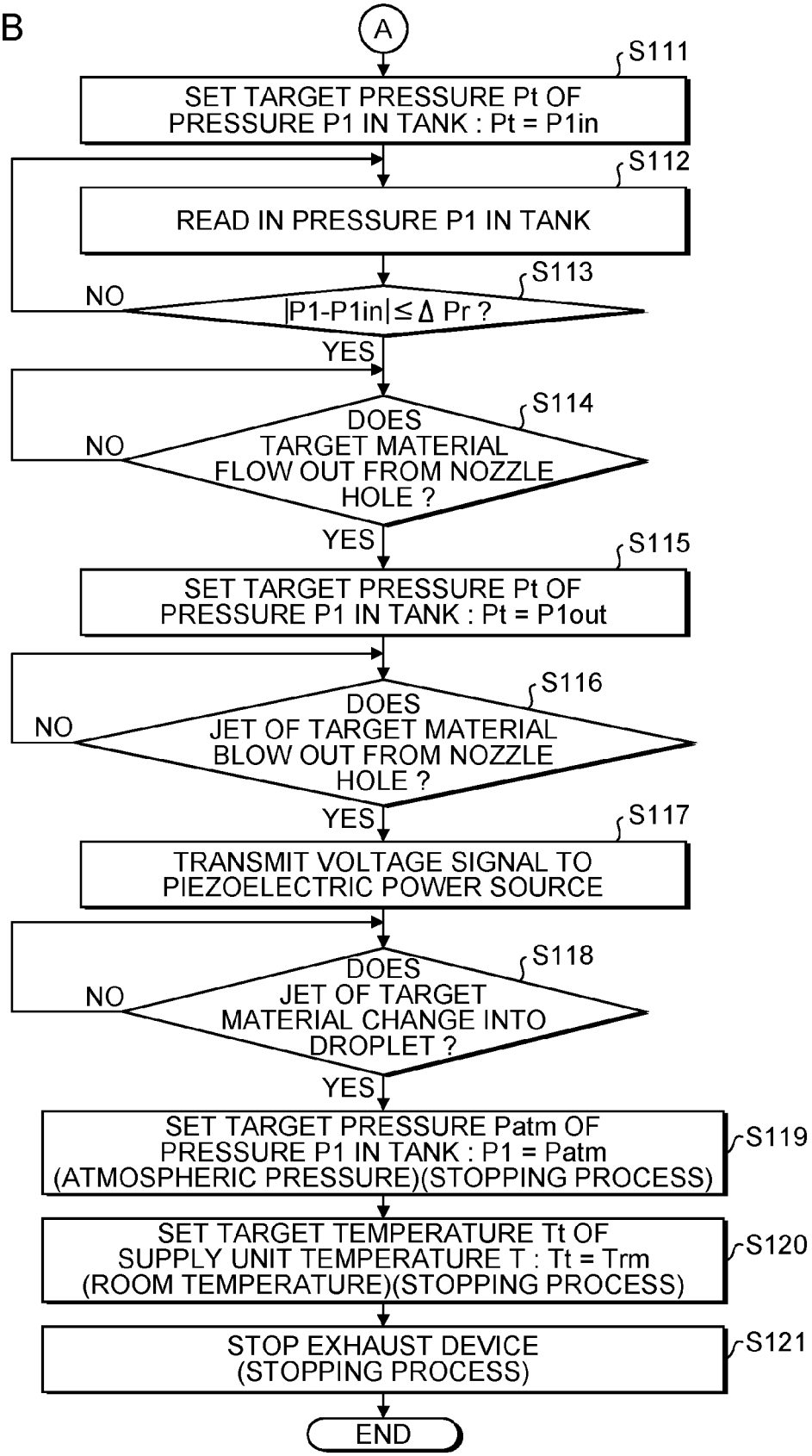
Figure 13:
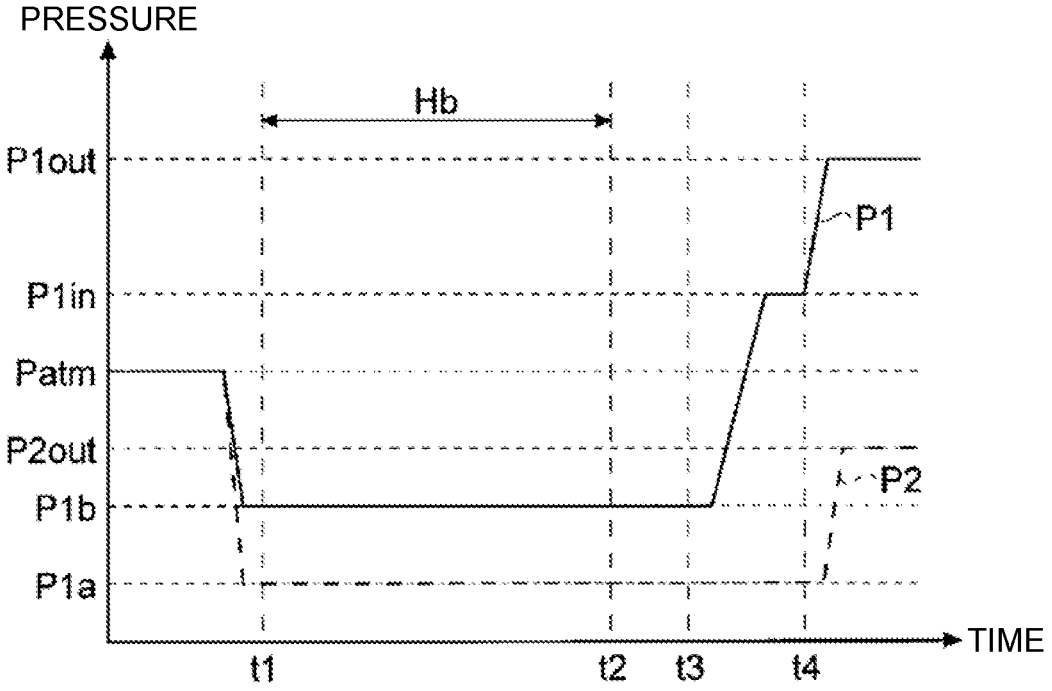
FIG. 13 is a timing chart of an example of a pressure change in a process including the baking process according to the embodiment.
Figure 14:
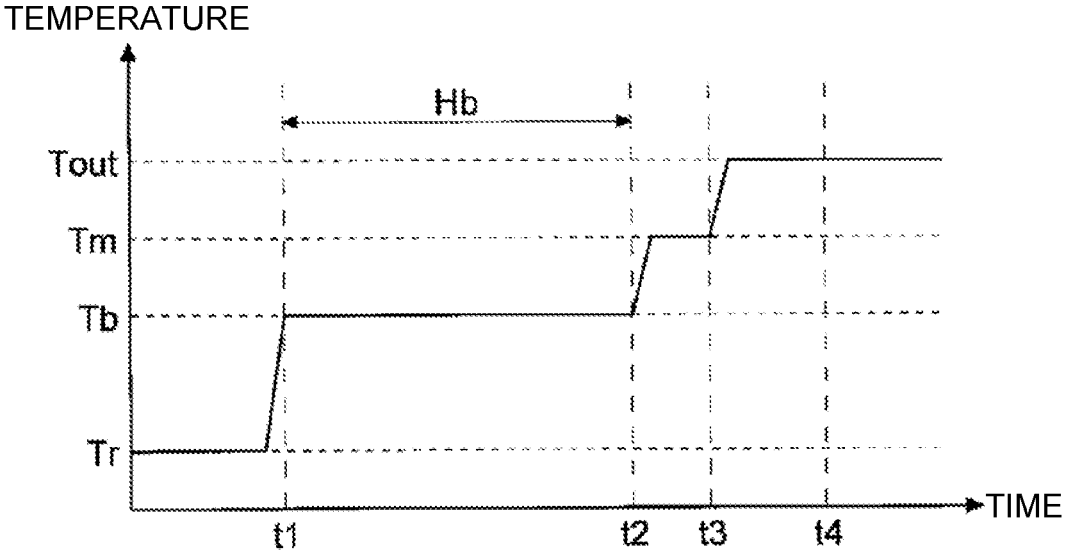
FIG. 14 is a timing chart of an example of a temperature change in the process including the baking process according to the embodiment.

FIGS. 12A and 12B are flow charts illustrating one example of the baking process according to the embodiment. FIG. 13 and FIG. 14 are diagrams explaining a processing condition (hereinafter, referred to as "baking condition") of the baking process according to the embodiment. FIG. 13 is a timing chart of an example of a pressure change in a process including the baking process according to the embodiment. FIG. 14 is a timing chart of an example of a temperature change in the process including the baking process according to the embodiment.

In FIG. 13, a solid line P1 illustrates a change in a pressure value detected by the pressure sensor 122 attached to the introduction tube 131, that is, a gas pressure (hereinafter, referred to as "in-tank pressure") P1 in the tank unit 260. A broken line P2 illustrates a change in a pressure value detected by the pressure sensor 506 attached to the chamber 502, that is, a gas pressure (hereinafter, referred to as "in-chamber pressure") P2 in the chamber 502. FIG. 14 illustrates a change in a temperature value detected by the temperature sensor 142 attached to the tank unit 260, that is, a temperature (hereinafter, referred to as "supply unit temperature") T in the target supply unit 26.

As illustrated in FIG. 12A, in the baking process according to the embodiment, the control unit 51 may first set a target temperature Tt of the supply unit temperature T as Tb in the temperature control unit 144 (step S101). Here, the target temperature Tb may be 110° C. or higher for removing the adsorbed water components. More preferably, the target temperature Tb may be 150° C. or higher. In addition, the target temperature Tb may be a temperature to the extent that the ingot 270 set in the tank unit 260 is not dissolved, that is, lower than a melting point (231.9° C.) of tin. Here, the temperature control unit 144 may adjust the supply unit temperature T to the target temperature Tb by controlling current to be supplied from the heater power source 143 to the heater 141 based upon a temperature value input from the temperature sensor 142.

The control unit 51 may set a target pressure Pt of the in-tank pressure P1 as P1*b* in the pressure control unit 121 (step S102). Here, the pressure control unit 121 may deliver the inactive gas (for example, Ar gas) supplied from the gas cylinder 130 into the tank unit 260 by opening the valve 123 and closing the valve 124. At this time, the pressure control unit 121 may adjust the in-tank pressure P1 to the target pressure P1*b* by controlling opening/closing of the valve 123 and the valve 124 based upon the pressure value from the pressure sensor 122 attached to the introduction tube 131.

Next, the control unit 51 may drive the exhaust device 504 to exhaust the inside of the chamber 502 (step S103). As a result, as illustrated prior to timing t1 in FIG. 13, the in-chamber pressure P2 may be P2*b*. When the in-tank pressure P1=P1*b* is higher than the in-chamber pressure P2=P2*b* (P1*b*>P2*b*), the gas in the target supply unit 26 can flow into the chamber 502. The gas having flowed into the chamber 502 can be exhausted by the exhaust device 504.

Next, the control unit 51 may determine whether or not a pressure difference between the in-tank pressure P1 and the in-chamber pressure P2 and the supply unit temperature T meet the baking condition. Specifically, the control unit 51 may read in the in-tank pressure P1 detected by the pressure sensor 122, the in-chamber pressure P2 detected by the pressure sensor 506, and the supply unit temperature T detected by the temperature sensor 142 (step S104). Subsequently the control unit 51 may determine whether or not the in-chamber pressure P2 is equal to or lower than P2*b* (P2<P2*b*), the in-tank pressure P1 is higher than the pressure P2*b* and is equal to or lower than the target pressure P1*b* (P2*b*<P1≤P1*b*), and an absolute value of a temperature difference between the supply unit temperature T and the target temperature Tb is equal to or lower than a predetermined allowance value ΔTr1 (|T−Tb|≤ΔTr1) (step S105). The control unit 51 may repeat step S104 to step S105 until the baking condition of step S105 is met (step 105; NO).

When the baking condition of step S105 is met (step S105; YES), the control unit 51 may, as illustrated in timing t1 to t2 in FIG. 13 and FIG. 14, perform control of maintaining the baking condition of step S105 for a baking time Hb. Specifically, the control unit 51 may reset a count value TC1 of an unillustrated timer and start to count a time (step S106), and may determine whether or not the baking time Hb has elapsed based upon the count value TC1 of the timer (step S107).

As described above, when the supply unit temperature T is increased to the target temperature Tb and the state is maintained for a predetermined time, water components adsorbed on the surface in the target supply unit 26 can be separated. At this time, the separated water component can be exhausted into the chamber 502 by forming flow of gases from the inside of the tank unit 260 into the chamber 502, and further, can be exhausted from the chamber 502 by the exhaust device 504.

Thereafter, the control unit 51 may set a target temperature Tt of the supply unit temperature T as Tout in the temperature control unit 144 (step S108). The target temperature Tout may be a temperature for dissolving the target material 271 (that is, ingot 270). The target temperature Tout may be a temperature equal to or higher than a melting point Tm (231.9° C. in a case of tin) of the target material 271, for example. In a case of using tin for the target material 271, the target temperature Tout may be a temperature of 240° C. or higher and 300° C. or lower, for example.

When the heating to the target temperature Tt=Tout is started by the temperature control unit 144, as illustrated in timing t2 to t3 in FIG. 14, the supply unit temperature T can increase to the melting point Tm of the target material 271. Then, when the entirety of the target material 271 is dissolved, as illustrated in timing t3 to t4 in FIG. 14, the supply unit temperature T again may start to increase to reach the target temperature Tout.

Therefore, the control unit 51 may read in a temperature value detected by the temperature sensor 142 (step S109) and determine whether or not an absolute value of a temperature difference between the read temperature value (supply unit temperature T) and the target temperature Tout is equal to or lower than a predetermined allowance value ΔTr(|T−out|≤ΔTr) (step S110). The control unit 51 may repeat step S109 to step 110 until the supply unit temperature T becomes stable in the vicinity (±ΔTr) of the target temperature Tout (step S110; NO).

When the supply unit temperature T is stable in the vicinity of the target temperature Tout (step S110; YES), the control unit 51 may set a target pressure Pt of the in-tank pressure P1 as P1in in the pressure control unit 121 (step S111). The target pressure P1in may be an in-tank pressure necessary for the dissolved target material 271 to pass through the filter portion 261. The target pressure P1in may be approximately 2 MPa, for example. Thereby as illustrated in timing t3 to t4 in FIG. 13, the in-tank pressure P1 increases to P1in and the target material 271 may flow out from the nozzle hole 265. However, at this stage an output form of the target material 271 is not necessarily a jet shape.

Subsequently, the control unit 51 may read in a pressure value detected by the pressure sensor 122 (step S112) and determine whether or not an absolute value of a pressure difference between the read pressure value (in-tank pressure P1) and the target pressure P1in is equal to or lower than a predetermined allowance value ΔPr (|P1−P1in|≤ΔPr) (step S113). The control unit 51 may repeat step S112 to step S113 until the in-tank pressure P1 becomes stable in the vicinity (P1in±ΔPr) of the target pressure P1in (step 113; NO).

When the in-tank pressure P1 is stable in the vicinity of the target pressure P1in (step S113; YES), the control unit 51 may determine whether or not the target material 271 flows out from the nozzle hole 265 by analyzing an image captured by the camera 508, for example (step S114).

In a case where it is determined that the target material 271 flows out from the nozzle hole 265 (step S114; YES), the control unit 51 may set the target pressure Pt of the in-tank pressure P1 as P1out in the pressure control unit 121 (step S115). The target pressure P1out may be a pressure higher than the target pressure P1in. The target pressure P1out may be a pressure within a range of 10 MPa to 40 MPa, for example.

As described above, when the in-tank pressure P1 is increased to P1out in a state of maintaining the supply unit temperature T to Tout, the target material 271 can be outputted in a jet shape from the nozzle hole 265. Therefore, the control unit 51 may determine whether or not the jet of the target material 271 blows out from the nozzle hole 265 by analyzing the image captured by the camera 508, for example (step S116). It should be noted that as illustrated after timing t4 in FIG. 13, the in-tank pressure P1 may be maintained in P1out. In a state where the jet of the target material 271 is outputted, the in-chamber pressure P2 may be increased to P2out, but at this time, a pressure difference for outputting the target material 271 in the jet shape is only required to be secured.

When it is determined that the jet of the target material 271 blows out from the nozzle hole 265 (step S116; YES), the control unit 51 may input a voltage signal of a predetermined waveform and a predetermined cycle to the piezoelectric element 111 by driving the piezoelectric power source 112 (step S117). Thereby the piezoelectric element 111 vibrates in the predetermined waveform and the predetermined cycle, and as a result, the jet of the target material 271 may be divided into droplets having a predetermined size and a predetermined cycle.

Next, the control unit 51 may determine whether or not the droplet (target 27) having the predetermined size and the predetermined cycle is generated by analyzing the image captured by the camera 508, for example (step S118). When it is determined that the droplet having the predetermined size and the predetermined cycle is not generated (step S118; NO), the control unit 51 may adjust the target pressure Pt of the pressure control unit 121 and/or the target temperature Tt of the temperature control unit 144, while repeating step S118.

In a case where it is determined that the droplet is generated (step S118; YES), the control unit 51 may execute the process of stopping the output of the target 27. In a case of stopping the output of the target 27, the control unit 51 may set the target pressure Pt of the pressure control unit 121 to an atmospheric pressure Patm (step S119) and set the target temperature Tt of the temperature control unit 144 to a room temperature Trm (step S120) and stop the exhaust device 504 (step S121), completing the present operation.

Here, the baking condition according to the embodiment will be described. In a case of setting the target pressure P2*b* of the in-chamber pressure P2 at the baking to 0.001 Pa or lower, the baking time Hb may be set within a range of 2 hours to 52 hours, and the target pressure Pb1 of the in-tank pressure P1 at the baking may be set within a range of Pb2<Pb1≤0.01 Pa to 2 MPa. In addition, in a case of setting the target pressure P2*b* of the in-chamber pressure P2 at the baking to 1 Pa or lower, the baking time Hb may be set within a range of 2 hours to 52 hours, and the target pressure Pb1 of the in-tank pressure P1 at the baking may be set within a range of Pb2<Pb1≤10 Pa to 2 MPa.

FIG. 15 illustrates an example of the baking condition according to the embodiment. In FIG. 15, the processing conditions of eleven patterns are exemplified. In the patterns illustrated in FIG. 15, in the patterns 8 to 11, the in-tank pressure P1 at the baking may be set higher than an atmospheric pressure. The most preferable pattern in the patterns 1 to 11 may be the pattern 10.

6.3 Effect

As described above, in a state of causing the gas to flow in a direction from the inside of the tank unit 260 into the chamber 502, the supply unit temperature T may be increased to a temperature equal to or higher than 110° C. and lower than a melting point (for example, 231.9° C.) of the target material 271. This state may be maintained for a predetermined time. Thereby, it is possible to separate the water component adsorbed in the inside of the target supply unit 26. The separated water component can be exhausted together with the inactive gas from the nozzle hole 265 into the chamber 502. That is, by maintaining the supply unit temperature T at a high temperature lower than the melting point of the target material 271 in a state where the inside of the tank unit 260 is purged by the inactive gas, a relatively large deal of water components adsorbed on the surface of the filter portion 261 can be removed or reduced.

As described above, when the water components in the target supply unit 26 are removed or reduced, it is possible to suppress oxides of solid substances (for example, tin oxides) from being generated due to reaction of the water component in the target supply unit 26 with the target material 271. As a result, the oxides are suppressed from reaching the nozzle hole 265, making it possible to stabilize the output of the target 27.

In addition, with the configuration of causing the inactive gas to flow from the inside of the tank unit 260 into the chamber 502, since it is not necessary to provide the exhaust device in the pressure adjuster 510-side, the configuration of the baking processing device 500 can be simplified.

6.4 Variation of Baking Processing Device

Here, Modifications of a baking processing device according to the embodiment will be described in detail with reference to the drawings.

6.4.1 Modification 1

First, a baking processing device according to Modification 1 will be described in detail with reference to the drawings.

In the baking processing device 500 illustrated in FIG. 11, the flow of the gas from the inside of the tank unit 260 into the chamber 502 is formed, but in the baking processing device according to Modification 1, the flow of the gas from inside of the chamber 502 into the tank unit 260 may be formed.

6.4.1.1 Configuration

Figure 16:
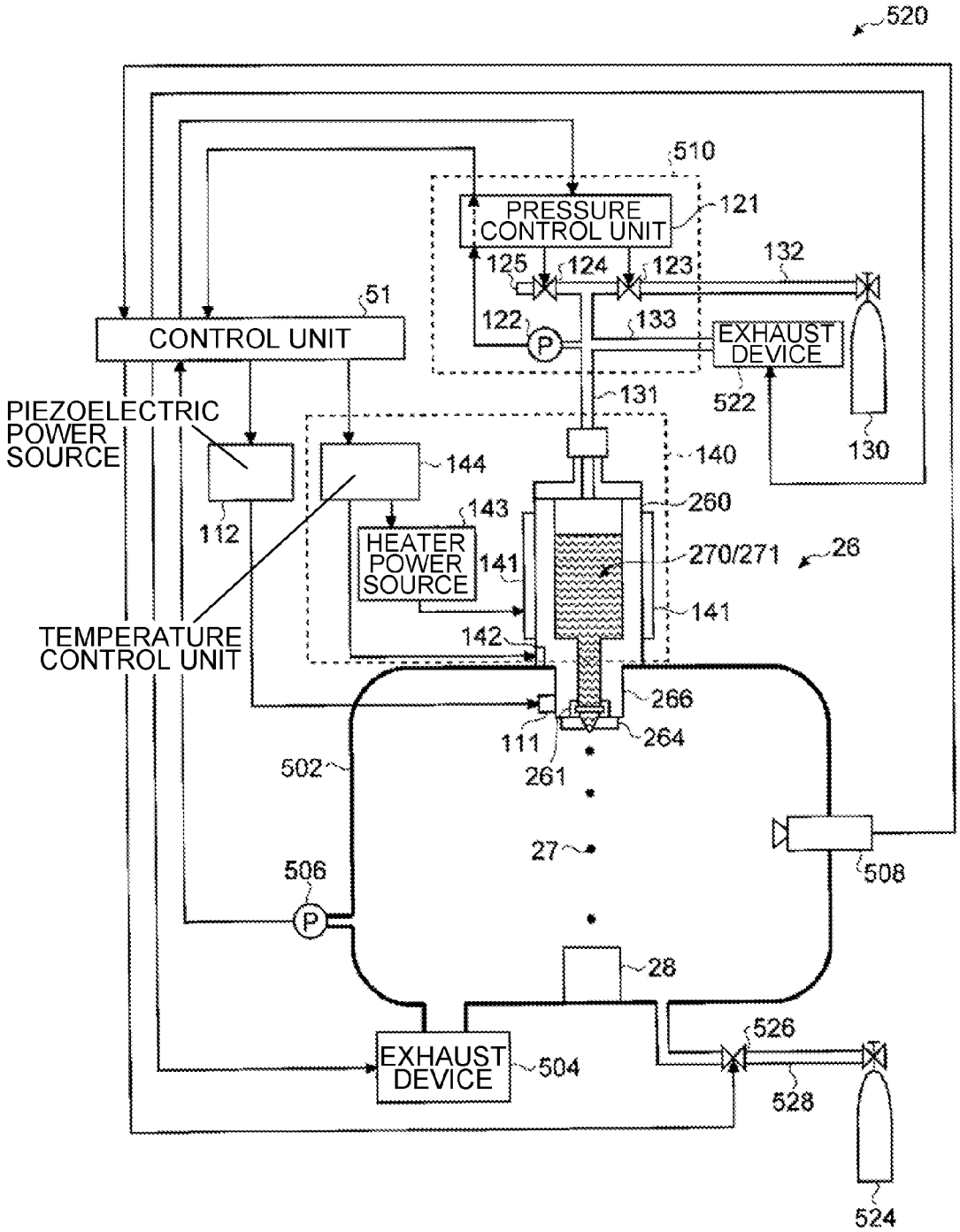
FIG. 16 is a schematic diagram of an example of a schematic configuration of a baking processing device according to Modification 1 of the embodiment.

FIG. 16 is a schematic diagram illustrating an example of the schematic configuration of the baking processing device according to Modification 1. In FIG. 16, components identical to those in the aforementioned baking processing device 500 are referred to as identical reference numerals and the overlapping explanations will be omitted.

As illustrated in FIG. 16, a baking processing device 520, in addition to the configuration as similar to the baking processing device 500 illustrated in FIG. 11, further includes an exhaust device 522 and a gas cylinder 524.

The exhaust device 522 may be connected to, for example, a pipe 133 branched from the introduction tube 131 leading to the tank unit 260. The exhaust device 522 may exhaust the inside of the tank unit 260.

The gas cylinder 524 may be connected to the chamber 502 through an introduction tube 528. The gas cylinder 524 may supply inactive gases into the chamber 502 through the introduction tube 528. The inactive gas may be an argon (Ar) gas, a helium (He) gas, a nitrogen gas or the like. A valve 526 may be provided on the introduction tube 528 to control the flow of the inactive gases supplied from the gas cylinder 524.

6.4.1.2 Operation

Subsequently an operation of the baking processing device 520 illustrated in FIG. 16 will be described.

First, the control unit 51 may control the in-chamber pressure P2 by controlling the valve 526 and the exhaust device 504 that are connected to the chamber 502.

In addition, the control unit 51 may exhausts gases in the target supply unit 26 by closing the valves 123 and 124 in the pressure adjuster 510 and driving the exhaust device 522.

Subsequently, the control unit 51 may read in the in-chamber pressure P2 detected by the pressure sensor 506 and the in-tank pressure P1 detected by the pressure sensor 122 respectively.

Further, the control unit 51 may control the valve 526 and the exhaust device 504 such that the in-chamber pressure P2 detected by the pressure sensor 506 becomes the target pressure P2*b* at the baking. As a result, since the in-tank pressure P1 is smaller than the in-chamber pressure P2, the gas in the chamber 502 can flow into the tank unit 260 through the nozzle hole 265. The gas having flowed into the tank unit 260 can be exhausted by the exhaust device 522.

Subsequently, the control unit 51 may set the target temperature Tt of the supply unit temperature T as Tb in the temperature control unit 144. As a result, the in-tank temperature T can be the baking temperature Tb in a state where the gas is flowing from the inside of the chamber 502 into the tank unit 260.

The flow of the gas from the inside of the chamber 502 into the tank unit 260 and the supply unit temperature T=Tb (±ΔTr) may be maintained during the baking time Hb.

Thereafter, when the baking time Hb elapses, the control unit 51 may close the valve 526 and stop the exhaust device 522, and may perform operations subsequent to step S108 in FIGS. 12A and 12 B.

6.4.1.3 Effect

As described above, the flow of the gas between the tank unit 260 and the chamber 502 is not limited to a direction from the inside of the tank unit 260 into the chamber 502, but may be in a direction from the inside of the chamber 502 into the tank unit 260. Even in this case, as similar to the aforementioned embodiment, since water components in the target supply unit 26 are reduced or removed, the stable output of the target 27 is made possible.

It should be noted that since the other configuration, operation and effect are similar to those in the aforementioned embodiment, the detailed explanation will be herein omitted.

6.4.2 Modification 2

Next, a baking processing device according to Modification 2 will be described in detail with reference to the drawings.

In the baking processing device described with reference to FIG. 12A to FIG. 14, the supply unit temperature T is maintained in the target temperature Tb (±ΔTr1) during the baking period of timing t1 to t2 in a state where the baking condition in step S105 in FIG. 12A is met. On the other hand, in Modification 2, the supply unit temperature T may go up and down during the baking period.

6.4.2.1 Configuration

Figure 17:
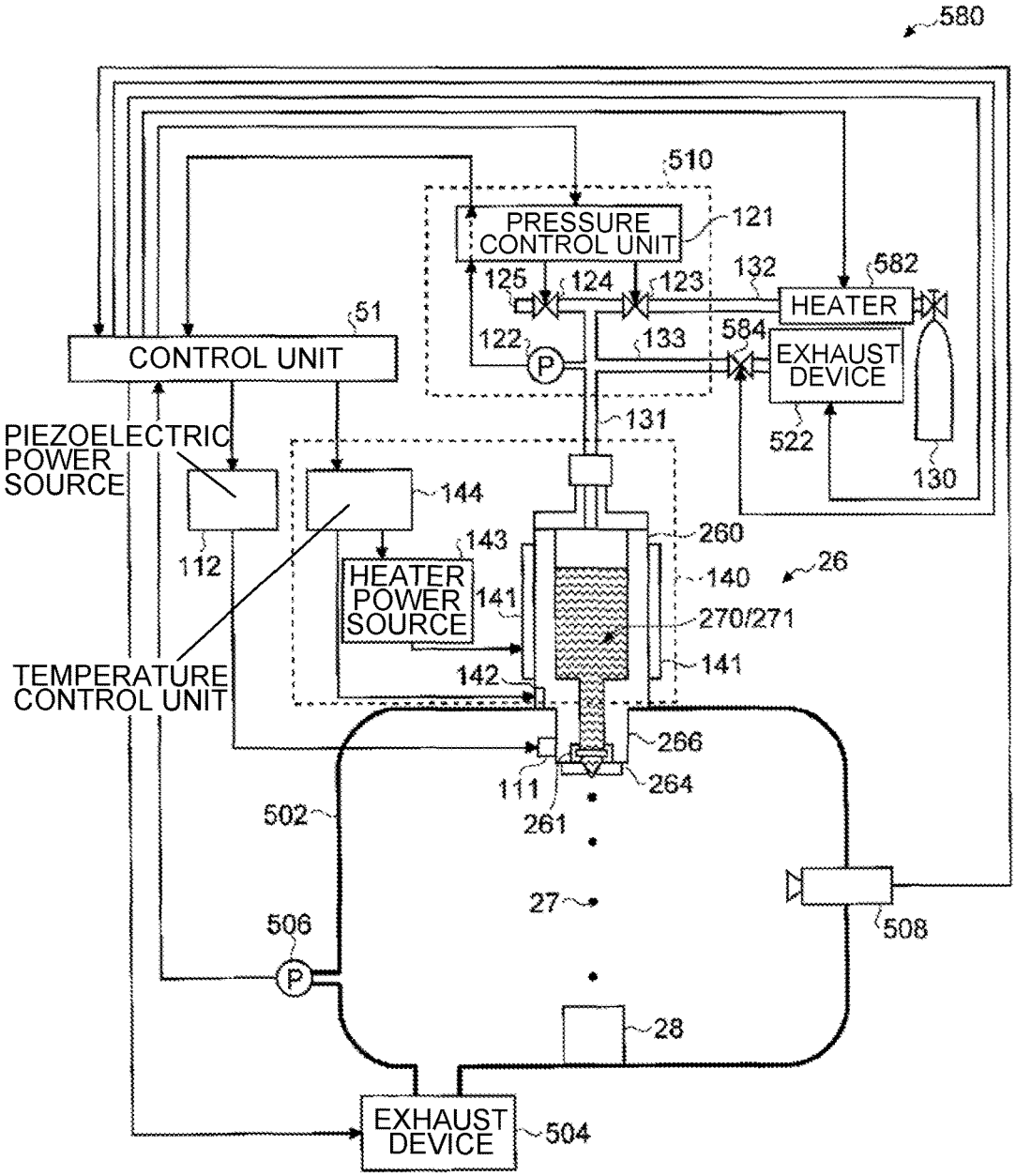
FIG. 17 is a schematic diagram of an example of a schematic configuration of a baking processing device according to Modification 2 of the embodiment.

FIG. 17 is a schematic diagram illustrating an example of the schematic configuration of the baking processing device according to Modification 2. In FIG. 17, components identical to those in the aforementioned baking processing device 500 or 520 are referred to as identical reference numerals and the overlapping explanations will be omitted.

As illustrated in FIG. 17, a baking processing device 580, in addition to the configuration as similar to the baking processing device 500 illustrated in FIG. 11, further includes the exhaust device 522 as similar to the baking processing device 520 illustrated in FIG. 16. The baking processing device 580 may further include a valve 584 provided on the pipe 133 and a heater 582 provided on the gas pipe 132.

The exhaust device 522 may be, as similar to FIG. 16, connected to, for example, the pipe 133 branched from the introduction tube 131 leading to the tank unit 260. The exhaust device 522 may exhaust the inside of the tank unit 260.

The heater 582 may heat the inactive gas flowing in the gas pipe 132.

6.4.2.2 Operation

Figure 18:
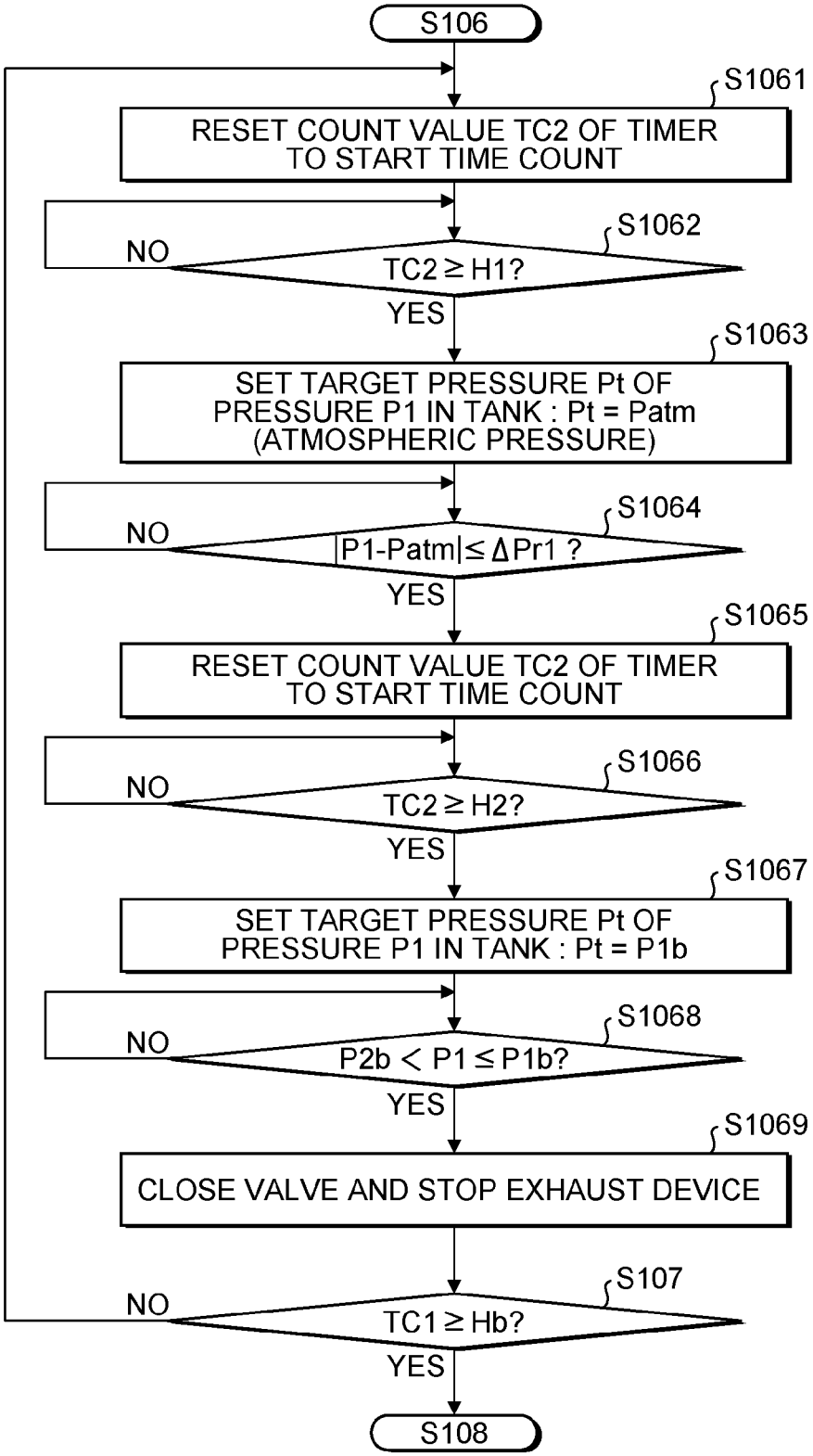
FIG. 18 is a flow chart of an example of a part of a baking process according to Modification 2 of the embodiment.
Figure 19:
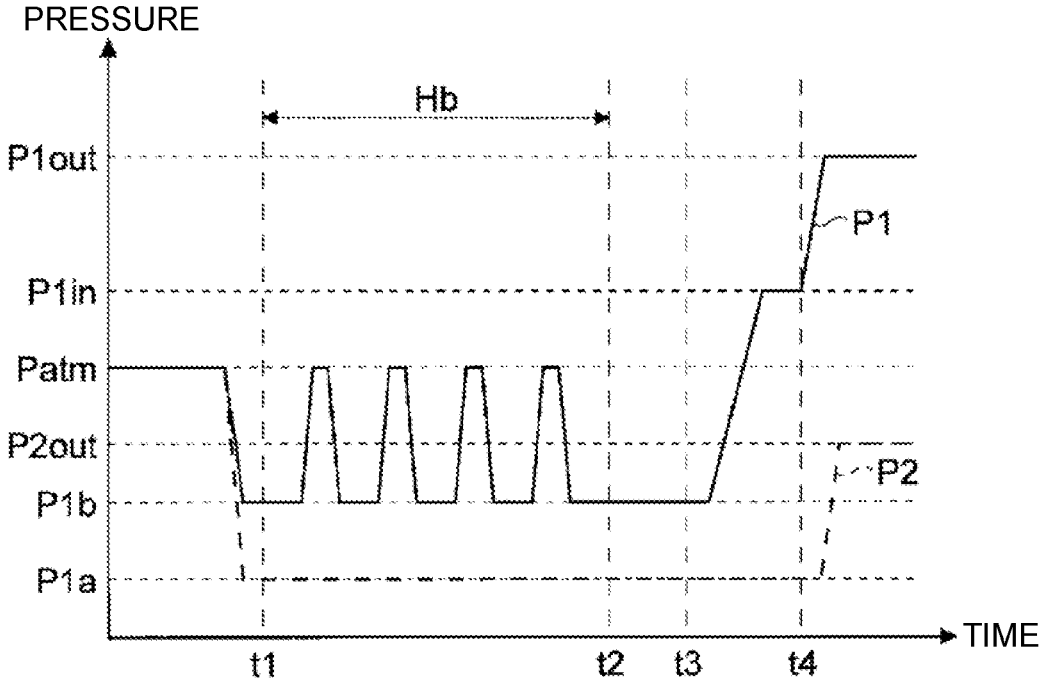
FIG. 19 is a timing chart of an example of a pressure change in a process including the baking process according to Modification 2 of the embodiment.

An operation of the baking processing device 580 illustrated in FIG. 17 will be described. FIG. 18 is a flow chart of an example of extracting a part of the baking process according to Modification 2. FIG. 19 is a timing chart of an example of a pressure change in the process including the baking process according to Modification 2.

The operation of the baking processing device 580 may add, for example, a step of operating the heater 582 to increase the inactive gas in the gas pipe 132 to the target temperature Tb subsequent to step S102 in FIG. 12A in the operation described using FIG. 12A to FIG. 14.

In addition, the control unit 51 may perform an operation illustrated in FIG. 18 subsequent to step S106 in FIG. 12A, that is, during the baking period of executing step S107.

As illustrated in FIG. 18, when the control unit 51 starts the baking period on a basis of a time count by a timer (step S106), next, a count value TC2 of another timer may be reset to start the time count (step S1061), and may determine whether or not a predetermined time H1 has elapsed based upon the count value TC2 of the timer (step S1062). It should be noted that the predetermined time H1 may be a time sufficiently shorter than the baking time Hb.

When the predetermined time H1 has elapsed (step S1062; YES), the control unit 51 may set the target pressure Pt of the in-tank pressure P1 as Patm (atmospheric pressure) in the pressure control unit 121 (step S1063) and wait until the in-tank pressure P1 reaches the target pressure Patm (step S1064; NO). On the other hand, the pressure control unit 121 may supply the inactive gas into the tank unit 260 from the gas cylinder 130 until the in-tank pressure P1 reaches the atmospheric pressure Patm by opening the valve 123 in a state where the valve 124 is closed.

Thereafter, when the absolute value of the pressure difference between the in-tank pressure P1 and the target pressure Patm is equal to or lower than a predetermined allowance value ΔPr1 (step S1064; YES), the control unit 51 may reset the count value TC2 of the same timer with that in step S1061 to start the time count (step S1065), and may determine whether or not a predetermined time H2 has elapsed based upon the count value TC2 of the timer (step S1066). It should be noted that the predetermined time H2 may be identical to or shorter than H1.

When the predetermined time H2 elapses (step S1066; YES), the control unit 51 may set the target pressure Pt of the in-tank pressure P1 as P1*b* in the pressure control unit 121 (step S1067), and may wait until the in-tank pressure P1 becomes higher than a pressure P2*b* and equal to or lower than the target pressure P1*b* (step S1068; NO). At this moment, the control unit 51 may open the valve 584 and drive the exhaust device 522 to exhaust the gas in the tank unit 260.

Thereafter, when the in-tank pressure P1 is higher than the pressure P2*b* and equal to or lower than the target pressure P1*b* (step S1068; YES), the control unit 51 may close the valve 584 and stop the exhaust device 522 (step S1069), and execute step S107 to determine whether or not the baking time Hb has elapsed. When the baking time Hb has not elapsed (step S107; NO), the control unit 51 may return to step S1061 and repeat operations subsequent to step S1061. On the other hand, when the baking time Hb has elapsed (step S107; YES), the control unit 51 may perform operations subsequent to step S108 in FIGS. 12A and 12B.

It should be noted that the operations of step S1061 to step S1069 may be repeatedly performed for each predetermined time (for example, three hours) until the baking time Hb elapses. As a result, as illustrated in FIG. 19, the in-tank pressure P1 may vary between the target pressure P1 and the atmospheric pressure Patm during the baking period.

6.4.2.3 Effect

As described above, the inactive gas is once filled in the tank unit 260 during the baking period, and the inactive gas is exhausted from a side of the tank relatively small in conductance, thereby making it possible to efficiently exhaust water components adsorbed in the target supply unit 26. It is possible to improve an exhaust efficiency of the water components in the target supply unit 26 by repeatedly performing this operation.

Further, when the inactive gas which will be filled in the tank unit 260 is preheated by the heater 582, it is possible to suppress a reduction in an inner temperature in the target supply unit 26 by introduction of new inactive gases. Particularly, since the inactive gas can function as a heat medium, it is possible to suppress the temperature reduction of the filter portion 261. Thereby it is possible to more efficiently separate the water components adsorbed on the surface in the inside of the target supply unit 26 of the filter portion 261 and the like.

In Modification 2, the in-tank pressure P1 is caused to vary between the target pressure P1*b* lower than the atmospheric pressure Patm and the atmospheric pressure Patm during the baking period, but is not limited to this condition. For example, the target pressure Pt may be made to the atmospheric pressure Ptam instead of the target pressure P1*b*, and a pressure at the filling may be made to a pressure (for example, 2 MPa) higher than the atmospheric pressure Patm instead of the atmospheric pressure Patm. In this case, the in-tank pressure P1 is caused to vary between the atmospheric pressure Patm and a pressure higher than the atmospheric pressure Patm during the baking period.

7. EUV Light Generation Device Including Baking Processing Device of Target Supply Unit The baking processing device illustrated in FIG. 11 or FIG. 16 may be incorporated in the chamber 2 in the EUV light generation device.

7.1 Configuration

Figure 20:
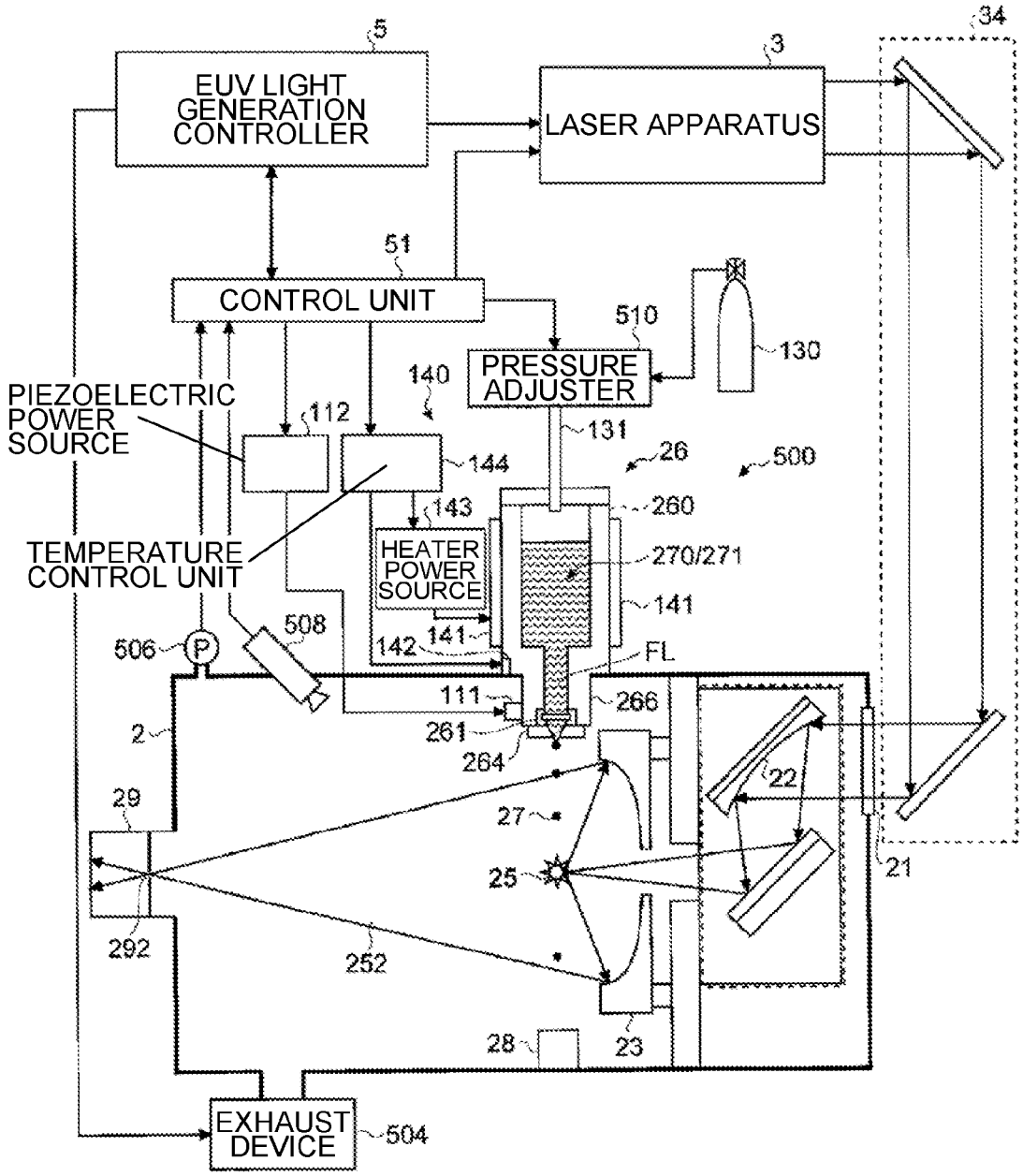
FIG. 20 is a schematic diagram of an example of a schematic configuration in a case of incorporating the baking processing device illustrated in FIG. 11 in a chamber of the EUV light generation device.

FIG. 20 is a schematic diagram of an example of the schematic configuration in a case of incorporating the baking processing device 500 illustrated in FIG. 11 in the chamber 2 of the EUV light generation device 1. In FIG. 20, components identical to those in the aforementioned EUV light generation device or baking processing device are referred to as identical reference numerals and the overlapping explanations will be omitted.

As illustrated in FIG. 20, the EUV light generation device may have the configuration in which the pressure adjuster 120 is replaced by the pressure adjuster 510 in the configuration as similar to the configuration illustrated in FIG. 2 and the exhaust device 504, the pressure sensor 506 and the camera 508 are attached to the chamber 2. The camera 508 may be arranged to image the target 27 in the vicinity of the plasma generation region 25. The other configurations may be similar to those of the aforementioned EUV light generation device or baking processing device.

7.2 Operation

A baking process and a baking condition in the EUV light generation device illustrated in FIG. 20 may be similar to the baking process and the baking condition described using FIG. 12A to FIG. 15, for example.

The EUV light generation device in which the target supply unit 26 is thus subjected to the baking process may generate EUV light 252 by performing operations as similar to the operations described using FIG. 2, for example.

7.3 Effect

As described above, in the baking processing device 500 according to the embodiment, the chamber 2 for EUV light generation may be used in place of the exclusive chamber 502. With this configuration, it is possible to eliminate the necessity of moving the target supply unit 26 after the baking process from the chamber 502 to the chamber 2. Generation of the EUV light is made possible in succession to the baking process in the target supply unit 26.

It should be noted that the baking processing device is not limited to the baking processing device 500 illustrated in FIG. 11, but, for example, the baking processing device 520 illustrated in FIG. 16 may be used. In this case, the configuration of the baking processing device 520 can be incorporated in the EUV light generation device (for example, chamber 2).

Since the other configuration, operation and effect are similar to those in the aforementioned embodiment, the detailed description will be herein omitted.

7.4 Variation of the EUV Light Generation Device in which the Baking Processing Device is Incorporated Here, the modification of the EUV light generation device according to the embodiment will be described in detail with reference to the drawings.

In the EUV light generation device illustrated in FIG. 20, the chamber 2 is used instead of the chamber 502 to form the flow of the gas from the inside of the tank unit 260 into the chamber 2 or from the inside of the chamber 2 into the tank unit 260. On the other hand, in the present modification, a space for gas flow formation may be provided between the tank unit 260 and the chamber 2. This space may be a space capable of being isolated from the chamber 2.

7.4.1 Configuration

Figure 21:
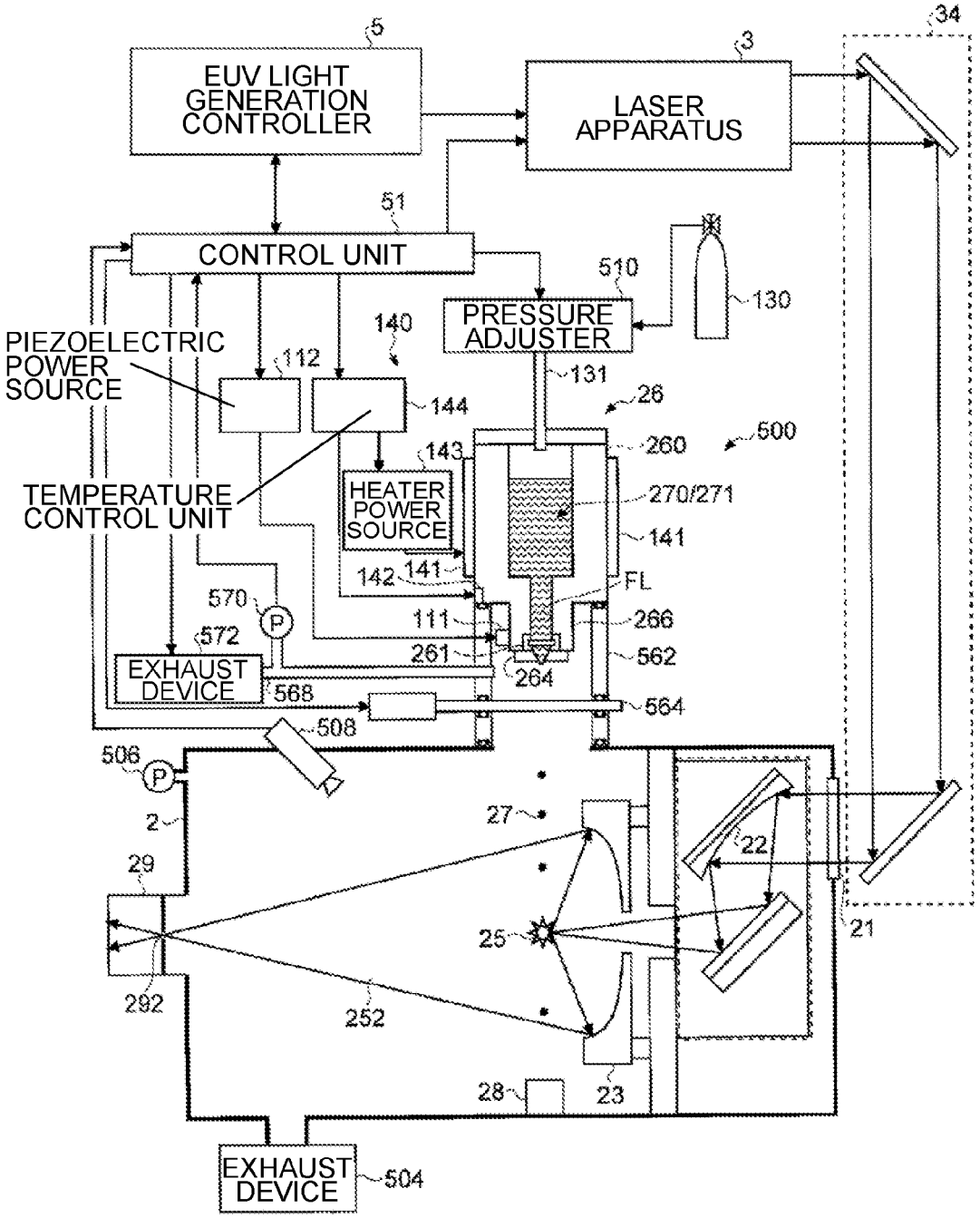
FIG. 21 is a schematic diagram of a modification of the EUV light generation device according to the embodiment.

FIG. 21 is a schematic diagram of a modification of the EUV light generation device according to the embodiment. In FIG. 21, components identical to those in the aforementioned EUV light generation device or baking processing device are referred to as identical reference numerals and the overlapping explanations will be omitted.

As illustrated in FIG. 21, the EUV light generation device may be provided with the configuration in which the target supply unit 26 and the chamber 2 are connected through a connecting tube 562 in the configuration as similar to that in the EUV light generation device illustrated in FIG. 20. The connecting tube 562 may be provided with a gate valve 564 that can perform isolation/communication between a first space in the target supply unit 26-side and a second space in the chamber 2-side.

An exhaust device 572 and a pressure sensor 570 may be connected through a pipe 568 to the first space in the target supply unit 26-side partitioned by the gate valve 564. The exhaust device 572 may exhaust the gas in the first space. The pressure sensor 570 may measure a gas pressure (hereinafter, referred to as "in-space gas pressure") in the first space.

The exhaust device 504 and the pressure sensor 506 that are attached to the chamber 2 may not be connected to the control unit 51.

The other configurations may be similar to those in the aforementioned EUV light generation device and baking processing device.

7.4.2 Operation

The baking process and the baking condition in the EUV light generation device illustrated in FIG. 21 may be similar to the baking process and the baking condition described using FIG. 13 to FIG. 15, for example. In the present modification, the exhaust device 572 and the pressure sensor 570 may be used instead of the exhaust device 504 and the pressure sensor 506 to form the flow of gases from the inside of the tank unit 260 into the first space. In addition, the control unit 51 may close the gate valve 564 during the baking process to isolate the first space from the second space, and may open the gate valve 564 after completion of the baking process to communicate the first space with the second space.

The EUV light generation device in which the target supply unit 26 is subjected to the baking process may generate the EUV light 252 by performing operations as similar to the operations described using FIG. 2, for example.

7.4.3 Effect

As described above, in the baking processing device 500 according to the modification, the first space sectioned by the connecting tube 562 and the gate valve 564 may be used in place of the exclusive chamber 502. With this configuration, as described above, it is possible to eliminate the necessity of moving the target supply unit 26 after the baking process from the chamber 502 to the chamber 2. The EUV light can be generated in succession to the baking process in the target supply unit 26.

It should be noted that, as described above, the baking processing device is not limited to the baking processing device 500 illustrated in FIG. 11, but, for example, the baking processing device 520 illustrated in FIG. 16 may be used. In this case, the configuration of the baking processing device 520 can be incorporated in the EUV light generation device (for example, the first space).

Since the other configuration, operation and effect are similar to those in the aforementioned embodiment, the detailed description will be herein omitted.

8. Others 8.1 Other Example of Dehydration Process

The dehydration process according to the embodiment is not limited to the aforementioned baking process. For example, as exemplified in FIG. 22, a desiccator 800 may be used to store dehydration agents 810.

Figure 22:
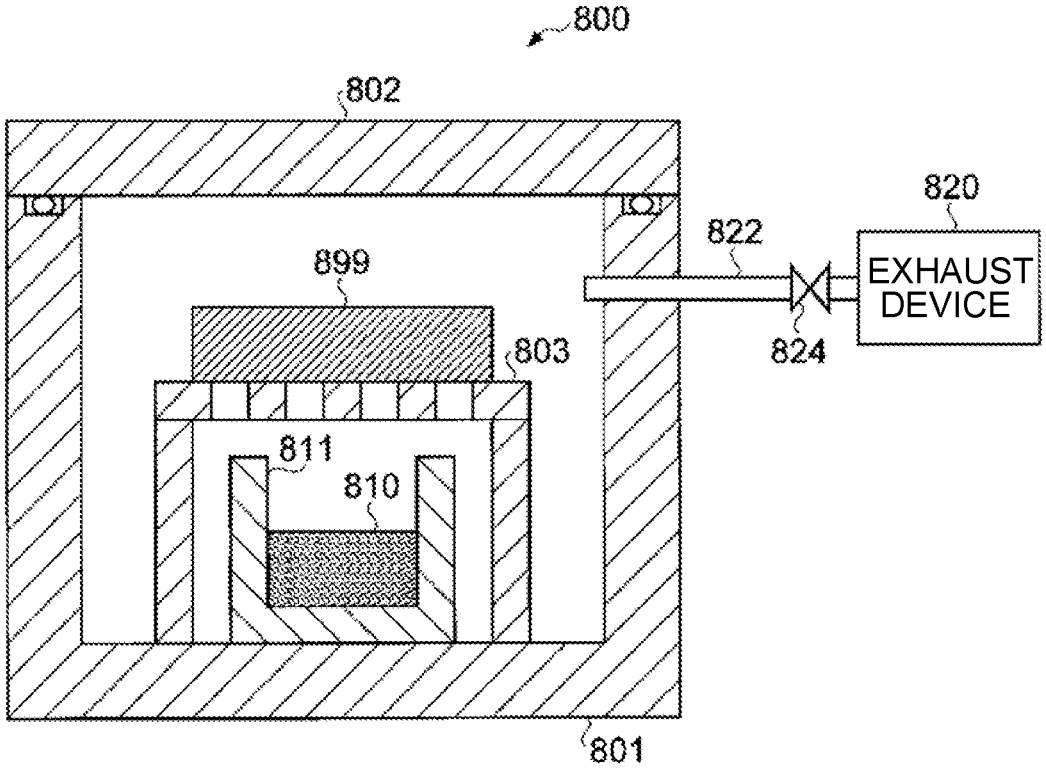
FIG. 22 is a schematic diagram of another example of a dehydration processing device according to the embodiment.

The desiccator 800 illustrated in FIG. 22 may include a hollow desiccator vessel 801 and a lid 802 for sealing the desiccator vessel 801. A component platform 803 and a dehydration agent vessel 811 may be provided in the desiccator vessel 801. A component 899 of a dehydration target may be placed on the component platform 803. The dehydration agent vessel 811 may reserve the dehydration agents 810. An example of the dehydration agent 810 may include silica gels, sulfuric acids, anhydrous sodium sulfates, magnesium perchlorates or the like. In the desiccator vessel 801, a space in which the component 899 is arranged may be communicated with a space in which the dehydration agents 810 are reserved.

An exhaust device 820 may be connected through a pipe 822 to the desiccator vessel 801. An opening/closing valve 824 may be provided on the pipe 822. The exhaust device 820 may exhaust the gas in the desiccator vessel 801 together with the evaporated water components.

The component 899 as the dehydration target may be stored in the desiccator 800 for several days to remove the water components adsorbed on the surface.

Also with the configuration as described above, it is possible to separate the water components adsorbed on each of the components in the target supply unit 26.

In the example illustrated in FIG. 22, a heater and the like may be arranged on the component platform 803 to perform the baking process to the component 899 placed on the component platform 803. In this case, it is possible to more effectively separate the water components adsorbed on each of the components.

8.2 Control Unit

A person skilled in the art will understand that the subject to be herein described will be carried out by an incorporation of a program module or a software application in a general computer or a programmable controller. In general, the program module includes the routines, programs, components, data structures and the like that can carry out the processes described in the present disclosure.

Figure 23:
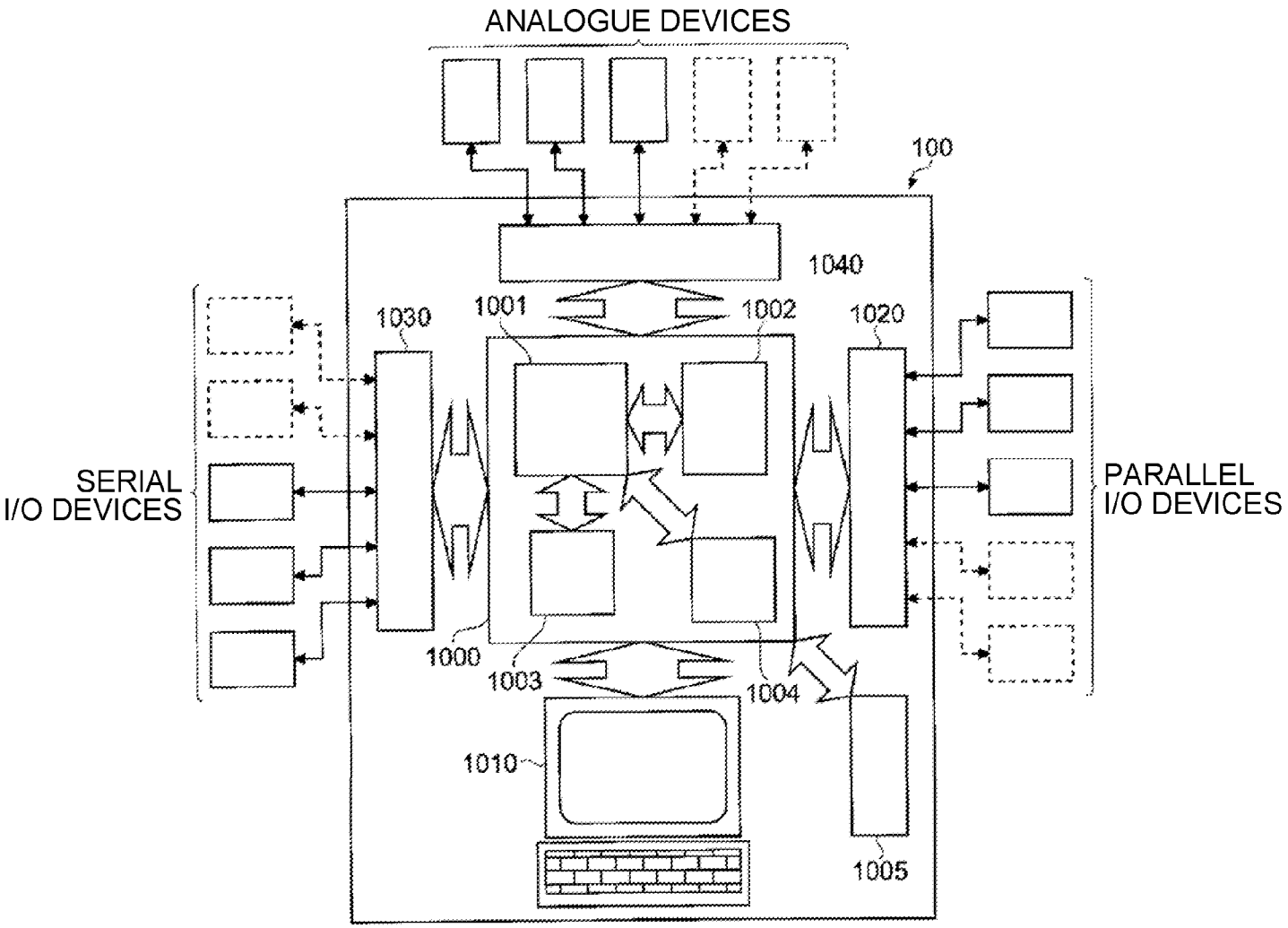
FIG. 23 is a block diagram of an illustrative hardware environment under which various aspects of a disclosed subject matter may be carried out.

FIG. 23 is a block diagram of an illustrative hardware environment under which various aspects of the subject to be disclosed can be carried out. The illustrative hardware environment 100 in FIG. 23 may include a processor unit 1000, a storage unit 1005, a user interface 1010, a parallel I/O (input-output) controller 1020, a serial I/O controller 1030 and an A/D (analog to digital) and D/A (digital to analog) converter 1040, but the configuration of the hardware environment 100 is not limited thereto.

The processor unit 1000 may include a central processor unit (CPU) 1001, a memory 1002, a timer 1003 and a graphics processing unit (GPU) 1004. The memory 1002 may include a random access memory (RAM) and a read-on memory (ROM). The CPU 1001 may be any one of commercially available processors. A dual microprocessor or another multiprocessor architecture may be used as the CPU 1001.

The configurations in FIG. 23 may be connected to each other for executing the processes described in the present disclosure.

In the operation, the processor unit 1000 may read in and execute the programs stored in the storage unit 1005, read in the data together with the programs from the storage unit 1005 and further, may write the data in the storage unit 1005. The CPU 1001 may carry out the programs read in from the storage unit 1005. The memory 1002 may be a working region that temporarily stores the programs to be carried out by the CPU 1001 and the data to be used for operation of the CPU 1001. The timer 1003 may measure a time interval and output a measurement result to the CPU 1001 according to the execution of the program. The GPU 1004 may process image data according to the program read in from the storage unit 1005 and output the processed result to the CPU 1001.

The parallel I/O controller 1020 may be connected to parallel I/O devices such as the EUV light generation controller 5 and the control unit 51, which are capable of being communicated with the processor unit 1000, and may control communication between the processor unit 1000 and the parallel I/O devices. The serial I/O controller 1030 may be connected to serial I/O devices such as the temperature control unit 144, the pressure control unit 121 and the piezoelectric power source 112, which are capable of being communicated with the processor unit 1000, and may control communication between the processor unit 1000 and the serial I/O devices. The A/D and D/A converter 1040 may be connected through analogue ports to analogue devices of various sensors such as the temperature sensor, the pressure sensor and the vacuum sensor, may control communication between the processor unit 1000 and the analogue devices, and may perform A/D or D/A conversion of communication contents.

The user interface 1010 may display the progress of the program carried out by the processor unit 1000 to an operator such that the operator can instruct the processor unit 1000 of stop of the program and execution of an interrupt routine.

The illustrative hardware environment 100 may be applied to the configuration of each of the EUV light generation controller 5, the control unit 51, the temperature control unit 144, the pressure control unit 121 and the like in the present disclosure. A person skilled in the art will understand that the controllers may be realized under a distributed computing environment, that is, under an environment in which tasks are carried out by the processor unit connected by a communication network. In the present disclosure, the EUV light generation controller 5, the control unit 51, the temperature control unit 144, the pressure control unit 121 and the like may be connected to each other through a communication network such as Ethernet (registered trademark) or the Internet. Under the distributed computing environment, the program module may be stored in local and remote memory storage devices both.

The above description should not be construed to be the limitation but is intended to be illustrative only. Accordingly, it should be apparent by a person skilled in the art that modifications of the embodiments of the present disclosure can be made without departing from the attached claims.

The terms used in the entirety of the present specification and the attached claims should be construed to be "non-restrictive". For example, the term such as "include" or "included" should be construed to mean "include, but should not be limited to". The term "have" should be construed to mean "have, but should not be limited to". The indefinite article "a" in the present specification and attached claims should be construed to mean "at least one" or "one or more".

What is claimed is:

1. A target supply device configured to supply a metal target in a plasma generation region, the target supply device comprising:

a tank configured to store the metal target material;

an ingot of the metal target material shaped to form a groove as a passage for gases between the ingot and an inner wall of the tank in a state where the ingot is stored in the tank;

a filter having been subjected to a dehydration process, the filter being configured to suppress passage of particles in the metal target material stored in the tank; and a nozzle provided with a nozzle hole, the nozzle being configured to eject, from the nozzle hole, the metal target that has passed through the filter.

2. The target supply device according to claim 1, wherein a water component adsorption amount per unit area of a surface of the filter is equal to or less than 2 $mg/m^2$.

3. The target supply device according to claim 1, wherein the dehydration process includes a baking process for heating the filter.

4. The target supply device according to claim 3, wherein the filter is heated in the baking process to a temperature equal to or higher than 110° C. and lower than a temperature at which the filter is damaged.

5. The target supply device according to claim 1, wherein at least one of the tank and the nozzle is subjected to the dehydration process.

6. The target supply device according to claim 1, further comprising a heater configured to heat the tank, wherein the heater heats and dissolves the ingot stored in the tank to form the metal target.

7. The target supply device according to claim 6, wherein the metal target is made of tin.

8. The target supply device according to claim 6, wherein the ingot is stored after removing oxides generated on a surface of the ingot.

9. The target supply device according to claim 1, wherein the ingot has a cylindrical shape, and the groove traverses longitudinally on a lateral face of the cylindrical shape.

10. A target supply device configured to supply a metal target in a plasma generation region, the target supply device comprising:

a tank configured to store the metal target material;

an ingot of the metal target material shaped to form a notch portion as a passage for gases between the ingot and an inner wall of the tank in a state where the ingot is stored in the tank;

a filter having been subjected to a dehydration process, the filter being configured to suppress passage of particles in the metal target material stored in the tank; and a nozzle provided with a nozzle hole, the nozzle being configured to eject, from the nozzle hole, the metal target that has passed through the filter.

11. The target supply device according to claim 10, further comprising a heater configured to heat the tank, wherein the heater heats and dissolves the ingot stored in the tank to form the metal target.

12. The target supply device according to claim 11, wherein the metal target is made of tin.

13. The target supply device according to claim 11, wherein the ingot is stored after removing oxides generated on a surface of the ingot.

14. The target supply device according to claim 10, wherein the ingot has a cylindrical shape, and the notch portion is formed in a corner portion in the cylindrical shape.

15. A target supply device configured to supply a metal target in a plasma generation region, the target supply device comprising:

a tank configured to store the metal target material;

an ingot of the metal target material shaped to form a through hole as a passage for gases between the ingot and an inner wall of the tank in a state where the ingot is stored in the tank;

a filter having been subjected to a dehydration process, the filter being configured to suppress passage of particles in the metal target material stored in the tank; and a nozzle provided with a nozzle hole, the nozzle being configured to eject, from the nozzle hole, the metal target that has passed through the filter.

16. The target supply device according to claim 15, further comprising a heater configured to heat the tank, wherein the heater heats and dissolves the ingot stored in the tank to form the metal target.

17. The target supply device according to claim 16, wherein the metal target is made of tin.

18. The target supply device according to claim 16, wherein the ingot is stored after removing oxides generated on a surface of the ingot.

19. The target supply device according to claim 15, wherein the ingot has a cylindrical shape, and the through hole penetrates from an upper surface to a bottom surface of the cylindrical shape.

* * * * *